US008827266B2

(12) United States Patent
Umi et al.

(10) Patent No.: US 8,827,266 B2
(45) Date of Patent: Sep. 9, 2014

(54) PAPER CONVEYING APPARATUS, JAM DETECTION METHOD, AND COMPUTER-READABLE, NON-TRANSITORY MEDIUM

(71) Applicant: PFU Limited, Kahoku (JP)

(72) Inventors: Takayuki Umi, Kahoku (JP); Masanobu Hongo, Kahoku (JP)

(73) Assignee: PFU Limited, Kahoku-shi (JP)

( * ) Notice: Subject to any disclaimer, the term of this patent is extended or adjusted under 35 U.S.C. 154(b) by 0 days.

(21) Appl. No.: 13/962,749

(22) Filed: Aug. 8, 2013

(65) Prior Publication Data

US 2014/0054840 A1 Feb. 27, 2014

(30) Foreign Application Priority Data

Aug. 24, 2012 (JP) ..... 2012-185378

(51) Int. Cl.

| | |
|---|---|
| ***B65H 7/02*** | (2006.01) |
| ***B65H 5/00*** | (2006.01) |
| ***B65H 3/02*** | (2006.01) |
| ***G03G 15/00*** | (2006.01) |

(52) U.S. Cl.

CPC .. *B65H 5/00* (2013.01); *B65H 3/02* (2013.01); *G03G 2215/00637* (2013.01); *G03G 15/70* (2013.01)

USPC ..... 271/258.01; 271/263

(58) Field of Classification Search

USPC ..... 271/258.01, 258.04, 263, 256

See application file for complete search history.

(56) References Cited

U.S. PATENT DOCUMENTS

| | | | | |
|---|---|---|---|---|
| 4,022,460 | A | 5/1977 | Pritchett | |
| 7,934,722 | B2 | 5/2011 | Namikawa | |
| 8,567,777 | B2 * | 10/2013 | Syracuse et al. | 271/263 |
| 8,585,050 | B2 * | 11/2013 | Syracuse et al. | 271/258.01 |
| 2003/0006550 | A1 | 1/2003 | Chujo et al. | |

(Continued)

FOREIGN PATENT DOCUMENTS

| | | |
|---|---|---|
| JP | 57-169767 | 10/1982 |
| JP | 60-112547 | 6/1985 |

(Continued)

OTHER PUBLICATIONS

Office action mailed Jul. 9, 2013 for JP 2012-185273 including English translation, 7pp.

(Continued)

*Primary Examiner* — David H Bollinger

(74) *Attorney, Agent, or Firm* — Christie, Parker & Hale, LLP

(57) ABSTRACT

There are provided a paper conveying apparatus, a jam detection method and a computer-readable, non-transitory medium that can suppress erroneous detection of the occurrence of a jam by a sound due to the sound generated along with conveyance of the paper. The paper conveying apparatus includes a first sound signal generator for generating a first sound signal, at least a part of the first sound signal generator is provided near a separator, a second sound signal generator for generating a second sound signal, at least a part of the second sound signal generator is provided at least at one end of a conveyance path of the paper, and a sound jam detector for determining whether a jam has occurred based on the second sound signal according to a detection method, wherein the sound jam detector changes the detection method based on the first sound signal.

7 Claims, 26 Drawing Sheets

(56) References Cited

U.S. PATENT DOCUMENTS

| | | | | |
|---|---|---|---|---|
| 2005/0269759 | A1 | 12/2005 | Sano et al. | |
| 2007/0070456 | A1 | 3/2007 | Nishimura | |
| 2008/0224390 | A1 | 9/2008 | Ma et al. | |
| 2009/0022536 | A1 | 1/2009 | Takeshita et al. | |
| 2009/0190939 | A1 | 7/2009 | Satoh et al. | |
| 2010/0272460 | A1 | 10/2010 | Zona et al. | |
| 2011/0238423 | A1 | 9/2011 | Schaertel et al. | |
| 2012/0235929 | A1 | 9/2012 | Hongo et al. | |
| 2013/0093136 | A1* | 4/2013 | Sakharshete et al. | 271/258.01 |
| 2013/0140757 | A1* | 6/2013 | Phinney et al. | 271/10.01 |
| 2013/0140766 | A1 | 6/2013 | Syracuse et al. | |
| 2014/0054841 | A1 | 2/2014 | Morikawa et al. | |
| 2014/0054849 | A1 | 2/2014 | Morikawa et al. | |
| 2014/0054851 | A1 | 2/2014 | Morikawa et al. | |
| 2014/0054852 | A1 | 2/2014 | Hongo et al. | |
| 2014/0061995 | A1* | 3/2014 | Shimazu | 271/3.14 |
| 2014/0062008 | A1* | 3/2014 | Hongo et al. | 271/258.01 |
| 2014/0062009 | A1* | 3/2014 | Hongo et al. | 271/258.01 |
| 2014/0077445 | A1 | 3/2014 | Morikawa et al. | |
| 2014/0077446 | A1 | 3/2014 | Hongo et al. | |

FOREIGN PATENT DOCUMENTS

| | | |
|---|---|---|
| JP | 61-169983 | 7/1986 |
| JP | 10-267742 | 10/1998 |
| JP | 11-053602 | 2/1999 |
| JP | 2001-302021 | 10/2001 |
| JP | 2002-205449 | 7/2002 |
| JP | 2003-295707 | 10/2003 |
| JP | 2006-322947 | 11/2006 |
| JP | 2007-079263 | 3/2007 |
| JP | 2008-290288 | 12/2008 |
| JP | 2009-249046 | 10/2009 |
| JP | 2011-112665 | 6/2011 |
| JP | 2012-131579 | 7/2012 |

OTHER PUBLICATIONS

Office action mailed Jul. 9, 2013 for JP 2012-185355 including English translation, 5pp.

Office action mailed Jul. 9, 2013 for JP 2012-185358 including English translation, 4pp.

Office action mailed Jul. 9, 2013 for JP 2012-185378 including English translation, 8pp.

Office action mailed Jul. 9, 2013 for JP 2012-203466 including English translation, 7pp.

Office action mailed Jul. 9, 2013 for JP 2012-203557 including English translation, 7pp.

* cited by examiner

PAPER CONVEYING APPARATUS, JAM DETECTION METHOD, AND COMPUTER-READABLE, NON-TRANSITORY MEDIUM

CROSS-REFERENCE TO RELATED APPLICATIONS

This application is based upon and claims the benefit of priority of prior Japanese Patent Application No. 2012-185378, filed on Aug. 24, 2012, the entire contents of which are incorporated herein by reference.

TECHNICAL FIELD

Embodiments discussed in the present specification relate to paper conveying technology.

BACKGROUND

In a paper conveying apparatus of an image reading apparatus, image copying apparatus, etc., sometimes a jam occurs when the paper moves along the conveyance path. In general, a paper conveying apparatus is provided with the function of determining whether a jam has occurred by a paper being conveyed to a predetermined position inside the conveyance path within a predetermined time from the start of conveyance of the paper and of stopping the operation of the apparatus when a jam has occurred.

On the other hand, if a jam occurs, a large sound is generated in the conveyance path, so the paper conveying apparatus can determine whether a jam has occurred based on the sound which is generated on the conveyance path and thereby detect the occurrence of a jam without waiting for the elapse of the predetermined time.

A jam detection apparatus of a copier which converts the sound which is generated on the conveyance path to an electrical signal and determines that a jam has occurred when the time when the signal is over a reference level exceeds a reference value has been disclosed (see Japanese Laid-open Patent Publication No. 57-169767).

SUMMARY

When for example a paper which has a wrinkle is conveyed or otherwise a large sound is generated at a conveyance path along with conveyance of a paper, sometimes it is erroneously determined that a jam has occurred.

Accordingly, it is an object of the present invention to provide a paper conveying apparatus and a jam detection method which can suppress erroneous detection of an occurrence of a jam by sound due to the sound which is generated along with conveyance of a paper and a computer-readable, non-transitory medium storing a computer program for causing a computer to implement such a jam detection method.

According to an aspect of the apparatus, there is provided a paper conveying apparatus. The paper conveying apparatus includes a separator, a first sound signal generator for generating a first sound signal corresponding to a sound generated by a paper during conveyance of the paper, at least a part of the first sound signal generator is provided near the separator, a second sound signal generator for generating a second sound signal corresponding to the sound generated by the paper during conveyance of the paper, at least a part of the second sound signal generator is provided at least at one end of a conveyance path of the paper in the direction which perpendicularly intersects the paper conveyance direction, and a sound jam detector for determining whether a jam has occurred based on the second sound signal according to a detection method, wherein the sound jam detector changes the detection method based on the first sound signal.

According to an aspect of the method, there is provide a jam detection method. The jam detection method includes acquiring a first sound signal from a first sound signal generator for generating a first sound signal corresponding to a sound generated by a paper during conveyance of the paper, at least a part of the first sound signal generator is provided near a separator, acquiring a second sound signal from a second sound signal generator for generating a second sound signal corresponding to the sound generated by the paper during conveyance of the paper, at least a part of the second sound signal generator is provided at least at one end of a conveyance path of the paper in the direction which perpendicularly intersects the paper conveyance direction, determining, by a computer, whether a jam has occurred based on the second sound signal according to a detection method, and changing by the computer the detection method based on the first sound signal, in the determining step.

According to an aspect of the computer-readable, non-transitory medium storing a computer program, the computer program causes a computer to execute a process, including acquiring a first sound signal from a first sound signal generator for generating a first sound signal corresponding to a sound generated by a paper during conveyance of the paper, at least a part of the first sound signal generator is provided near a separator, acquiring a second sound signal from a second sound signal generator for generating a second sound signal corresponding to the sound generated by the paper during conveyance of the paper, at least a part of the second sound signal generator is provided at least at one end of a conveyance path of the paper in the direction which perpendicularly intersects the paper conveyance direction, determining whether a jam has occurred based on the second sound signal according to a detection method, and changing by the computer the detection method based on the first sound signal, in the determining step.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

DESCRIPTION OF EMBODIMENTS

Hereinafter, a paper conveying apparatus, jam detection method, and computer program according to an embodiment, will be described with reference to the drawings. However, note that the technical scope of the invention is not limited to these embodiments and extends to the inventions described in the claims and their equivalents.

Figure 1:
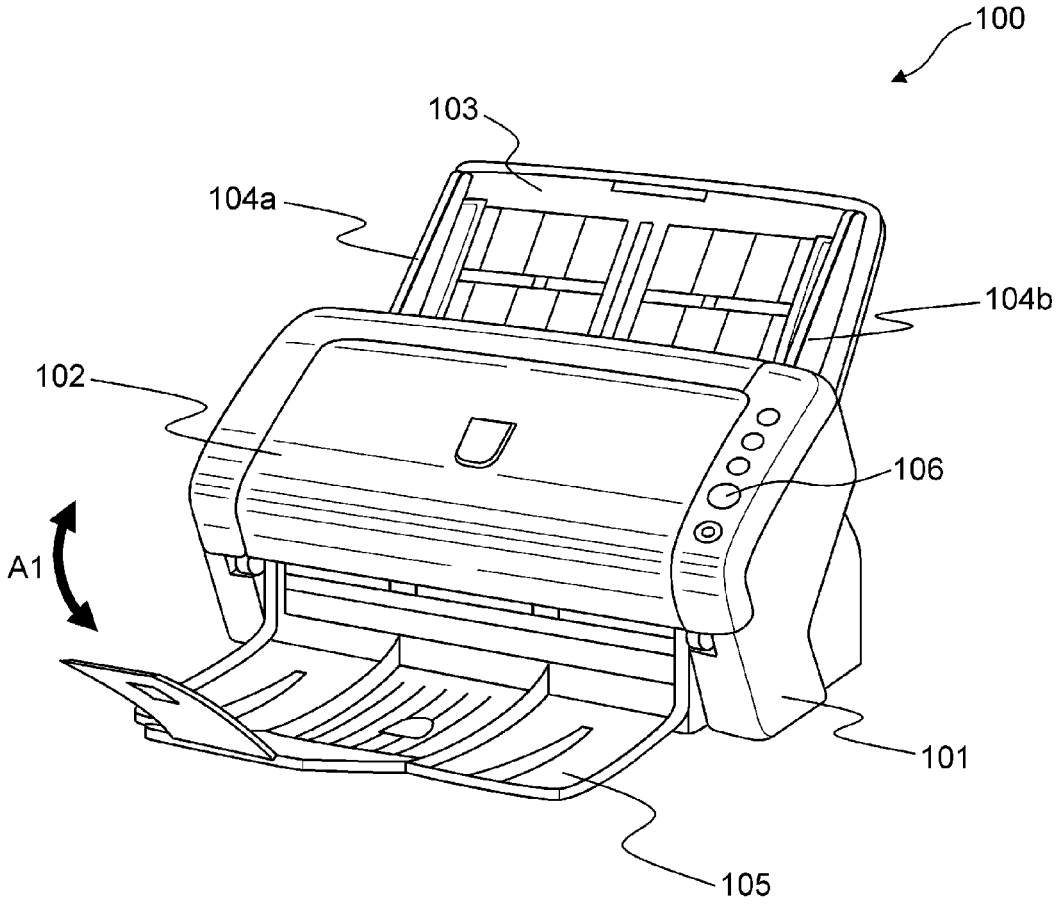
FIG. 1 is a perspective view which shows a paper conveying apparatus 100 according to an embodiment.

FIG. 1 is an exemplary embodiment of a perspective view which shows a paper conveying apparatus 100 which is configured as an image scanner, according to an embodiment.

The paper conveying apparatus 100 includes a lower housing 101, an upper housing 102, a paper tray 103, an ejection tray 105, an operation button 106, etc.

The upper housing 102 is arranged at a position which covers the top surface of the paper conveying apparatus 100 and is engaged with the lower housing 101 by hinges so as to be able to be opened and closed at the time of a paper jam, at the time of cleaning of the inside of the paper conveying apparatus 100, etc.

The paper tray 103 is engaged with the lower housing 101 in a manner enabling a paper to be placed. The paper tray 103 is provided with side guides 104*a* and 104*b* which can be moved in a direction perpendicular to a conveyance direction of the paper, that is, to the left and right directions from the conveyance direction of the paper. By positioning the side guides 104*a* and 104*b* to match with the width of the paper, it is possible to limit the width direction of the paper.

The ejection tray 105 is engaged with the lower housing 101 by hinges so as to be able to pivot in the direction which is shown by an arrow mark A1. In the opened state as shown in FIG. 1, the ejected paper can be held.

The operation button 106 is arranged on the surface of the upper housing 102. If pushed, it generates and outputs an operation detection signal.

Figure 2:
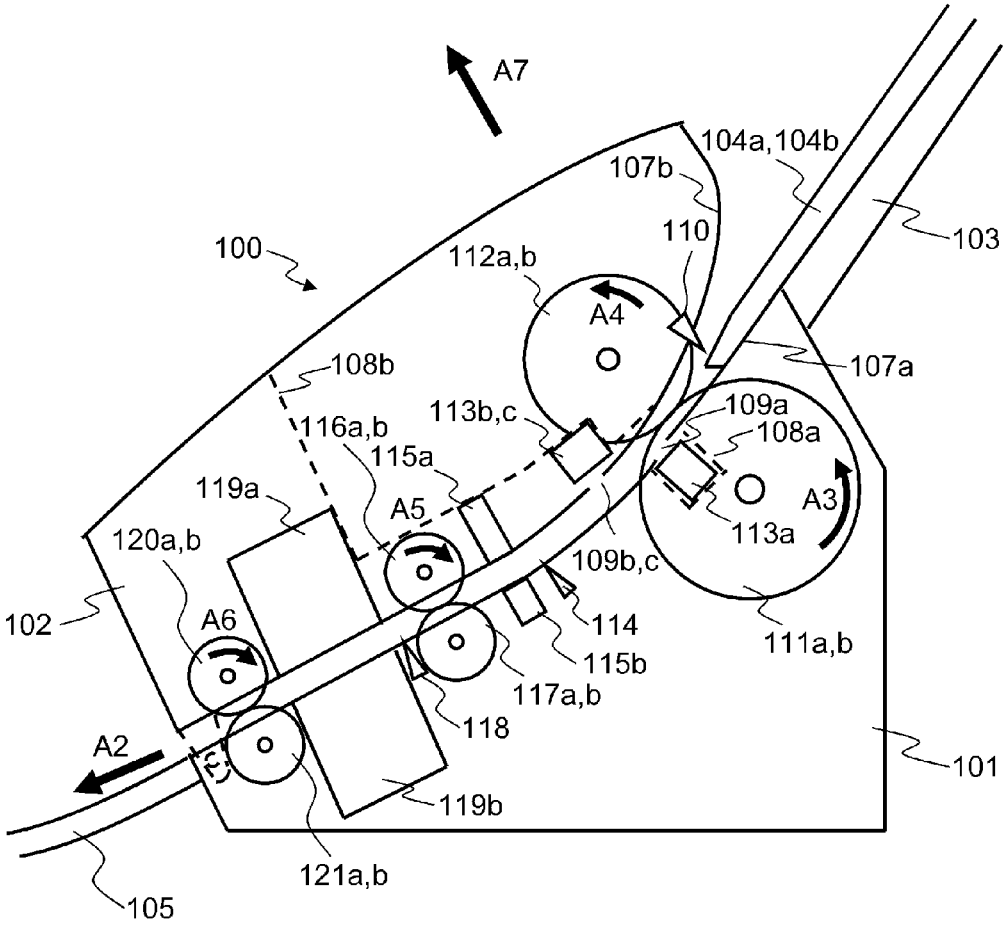
FIG. 2 is a view for explaining an example of a conveyance route at an inside of a paper conveying apparatus 100.

FIG. 2 is a view for explaining an example of the conveyance route at the inside of the paper conveying apparatus 100.

The conveyance route at the inside of the paper conveying apparatus 100 has a first paper detector 110, paper feed rollers 111*a*, 111*b*, retard rollers 112*a*, 112*b*, microphones 113*a*, 113*b*, 113*c*, a second paper detector 114, an ultrasonic transmitter 115*a*, an ultrasonic receiver 115*b*, first conveyor rollers 116*a*, 116*b*, first driven rollers 117*a*, 117*b*, a third paper detector 118, a first image capture unit 119*a*, a second image capture unit 119*b*, second conveyor rollers 120*a*, 120*b*, second driven rollers 121*a*, 121*b*, etc.

Below, the paper feed rollers 111*a* and 111*b* sometimes will be referred to altogether as the "paper feed rollers 111", the retard rollers 112*a* and 112*b* sometimes will be referred to altogether as the "retard rollers 112", the first conveyor rollers 116*a* and 116*b* sometimes will be referred to altogether as the "first conveyor rollers 116", the first driven rollers 117*a* and 117*b* sometimes will be referred to overall as the "first driven rollers 117", the second conveyor rollers 120*a* and 120*b* sometimes will be referred to overall as the "second conveyor rollers 120", and the second driven rollers 121*a* and 121*b* sometimes will be referred to overall as the "second driven rollers 121".

The top surface of the lower housing 101 forms the lower guide 107*a* of the conveyance path of the paper, while the bottom surface of the upper housing 102 forms the upper guide 107*b* of the conveyance path of the paper. In FIG. 2, the arrow mark A2 shows the conveyance direction of the paper. Below, "upstream" means upstream of the conveyance direction A2 of the paper, while "downstream" means downstream of the conveyance direction A2 of the paper.

The first paper detector 110 has a contact detection sensor which is arranged at an upstream side of the paper feed roller 111 and the retard roller 112 and detects if a paper is placed on the paper tray 103. The first paper detector 110 generates and outputs a first paper detection signal which changes in signal value between a state in which a paper is placed on the paper tray 103 and a state in which one is not placed.

The first microphone 113*a*, the second microphone 113*b*, and third microphone 113*c* are examples of sound detectors, respectively detect the sound generated by a paper during conveyance of the paper, and generate and output analog signals which are generated from the detected sound. The first microphone 113*a* is arranged near the paper feed rollers 111 and retard rollers 112 while fastened to a frame 108*a* at the inside of the lower housing 103. The second microphone 113*b* and third microphone 113*c* are arranged at the downstream side of the paper feed rollers 111 and the retard rollers 112 while fastened to the frame 108*b* at the inside of the upper housing 102. To enable the sound generated by the paper during conveyance of the paper to be more accurately detected by the first microphone 113*a*, the second microphone 113*b*, and third microphone 113*c*, a hole 109*a* is provided in the lower guide 107*a* facing the first microphone 113*a* and holes 109*b* and 109*c* are provided in the upper guide 107*b* facing the second microphone 113*b* and third microphone 113*c*.

The second paper detector 114 has a contact detection sensor which is arranged at a downstream side of the paper feed roller 111 and the retard roller 112 and at an upstream side of the first conveyor roller 116 and first driven roller 117 and detects if there is a paper present at that position. The second paper detector 114 generates and outputs a second paper detection signal which changes in signal value between a state at which there is a paper at that position and a state where there is no paper there.

The ultrasonic transmitter 115*a* and the ultrasonic receiver 115*b* are an example of an ultrasonic detector, and are arranged near the conveyance path of the paper so as to face each other across the conveyance path. The ultrasonic transmitter 115*a* transmits an ultrasonic wave. On the other hand, the ultrasonic receiver 115*b* detects an ultrasonic wave which is transmitted by the ultrasonic transmitter 115*a* and passes through the paper or papers, and generates and outputs an ultrasonic signal comprised of an electrical signal corresponding to the detected ultrasonic wave. Below, the ultrasonic transmitter 115*a* and the ultrasonic receiver 115*b* will sometimes be referred to altogether as the "ultrasonic sensor 115".

The third paper detector 118 has a contact detection sensor which is arranged at a downstream side of the first conveyor roller 116 and the first driven roller 117 and an upstream side of the first image capture unit 119*a* and the second image capture unit 119*b* and detects if there is a paper at that position. The third paper detector 118 generates and outputs a third paper detection signal which changes in signal value between a state where there is a paper at that position and a state where there is no such paper there.

The first image capture unit 119*a* has a CIS (contact image sensor) of an equal magnification optical system type which is provided with an image capture element using CMOS's (complementary metal oxide semiconductors) which are arranged in a line in the main scan direction. This CIS reads the back surface of the paper and generates and outputs an analog image signal. Similarly, the second image capture unit 119*b* has a CIS of an equal magnification optical system type which is provided with an image capture element using CMOS's which are arranged in a line in the main scan direction. This CIS reads the front surface of the paper and generates and outputs an analog image signal. Note that, it is also possible to arrange only one of the first image capture unit 119*a* and the second image capture unit 119*b* and read only one surface of the paper. Further, instead of a CIS, it is also possible to utilize an image capturing sensor of a reduced magnification optical system type using CCD's (charge coupled devices). Below, the first image capture unit 119*a* and the second image capture unit 119*b* will sometimes be referred to overall as the "image capture units 119".

A paper which is placed on the paper tray 103 is conveyed between the lower guide 107*a* and the upper guide 107*b* toward the paper conveyance direction A2 by rotation of the paper feed roller 111 in the direction of the arrow mark A3 of FIG. 2. The retard roller 112 rotates in the direction of the arrow mark A4 of FIG. 2 at the time of paper conveyance. Due to the action of the paper feed roller 111 and the retard roller 112, when the paper tray 103 has a plurality of papers placed on it, among the papers which are placed on the paper tray 103, only the paper which is in contact with the paper feed roller 111 is separated. The conveyance of papers other than the separated paper is restricted (prevention of multifeed). The paper feed roller 111 and the retard roller 112 function as a paper separator.

A paper is fed between the first conveyor roller 116 and the first driven roller 117 while being guided by the lower guide 107*a* and the upper guide 107*b*. The paper is sent between the first image capture unit 119*a* and the second image capture unit 119*b* by the first conveyor roller 116 rotating in the direction of the arrow mark A5 of FIG. 2. The paper which is read by the image capture unit 119 is ejected onto the ejection tray 105 by the second conveyor roller 120 rotating in the direction of the arrow mark A6 of the FIG. 2.

Figure 3:
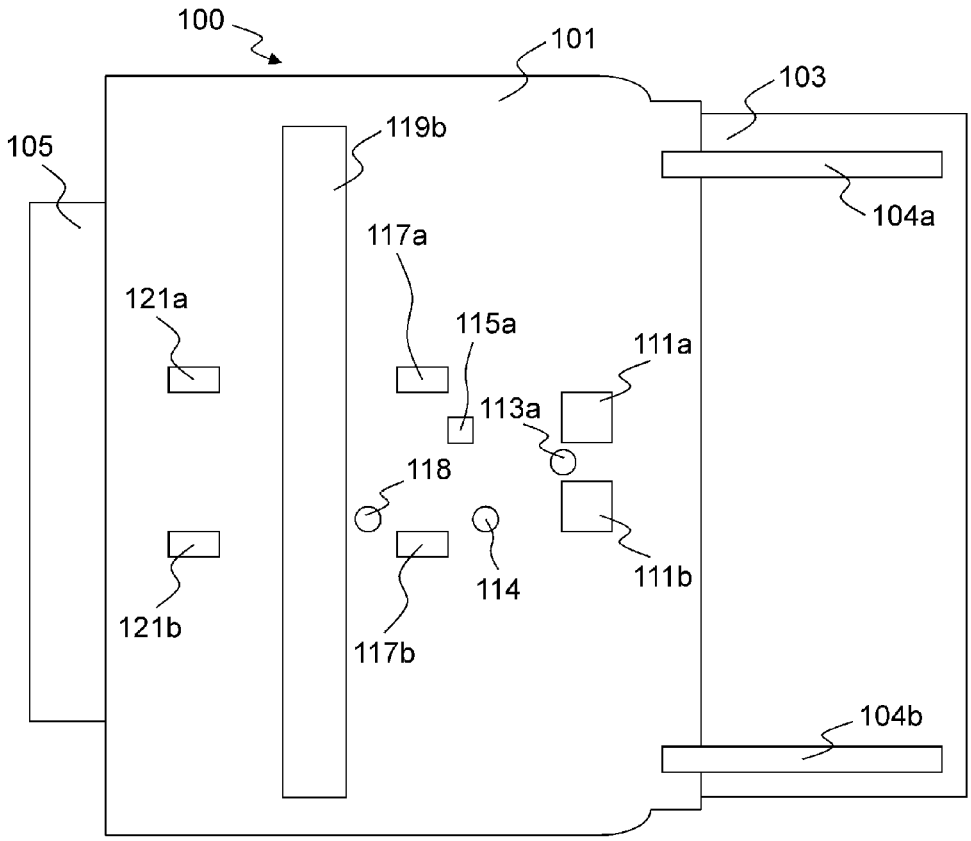
FIG. 3 is an example of a view of a paper conveying apparatus 100 seen from above with an upper housing 102 detached.

FIG. 3 is an example of a view of the paper conveying apparatus 100 seen from above in the state with the upper housing 102 detached, that is, a view seen in the opposite direction to the arrow mark A7 of FIG. 2.

As shown in FIG. 3, the first microphone 113*a* is provided near the paper feed rollers 111 and retard rollers 112. The first microphone 113*a* is preferably provided between the paper feed rollers 111*a* and 111*b* in a direction perpendicularly intersecting the paper conveyance direction, but may also be provided at the outsides of the paper feed rollers 111*a* and 111*b* in the direction perpendicularly intersecting the paper conveyance direction.

Figure 4:
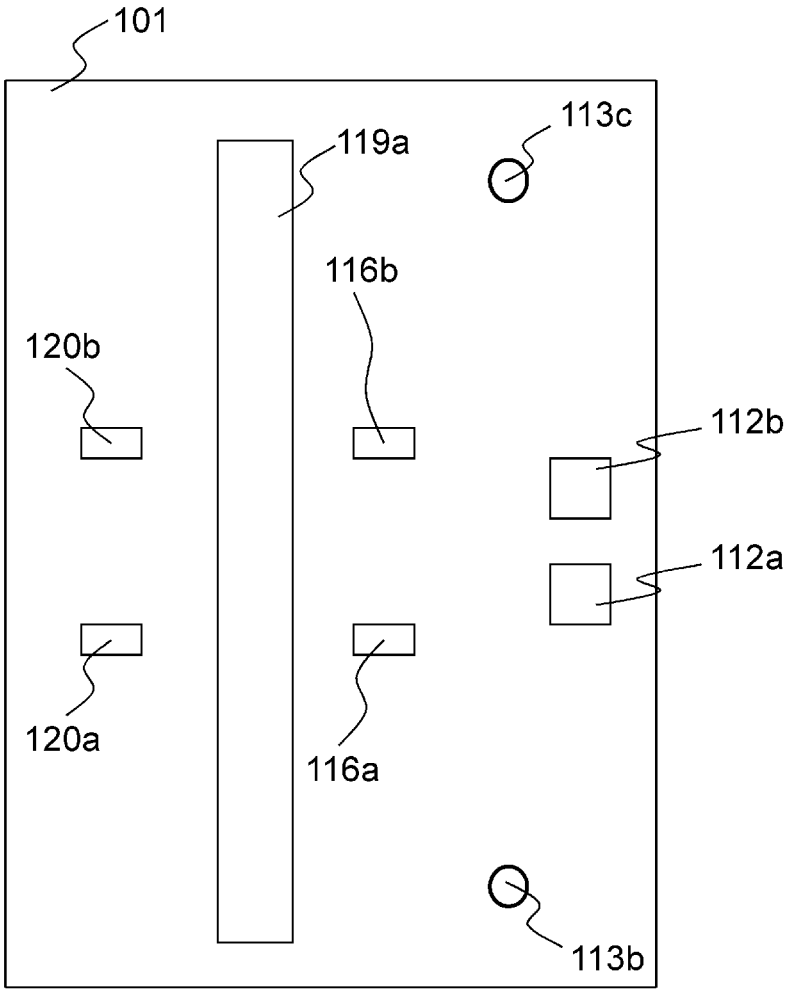
FIG. 4 is an example of a view seen from a lower side in the state with an upper housing 102 detached.

FIG. 4 is an example of a view seen from below in the state with the upper housing 102 detached from the paper conveying apparatus 100, that is, a view seen in the direction of the arrow mark A7 of FIG. 2.

As shown in FIG. 4, the second microphone 113*b* is provided at one end of the conveyance path of the paper in the direction perpendicularly intersecting the paper conveyance direction, while the third microphone 113*c* is provided at the other end of the conveyance path of the paper in the direction perpendicularly intersecting the paper conveyance direction.

Figure 5:
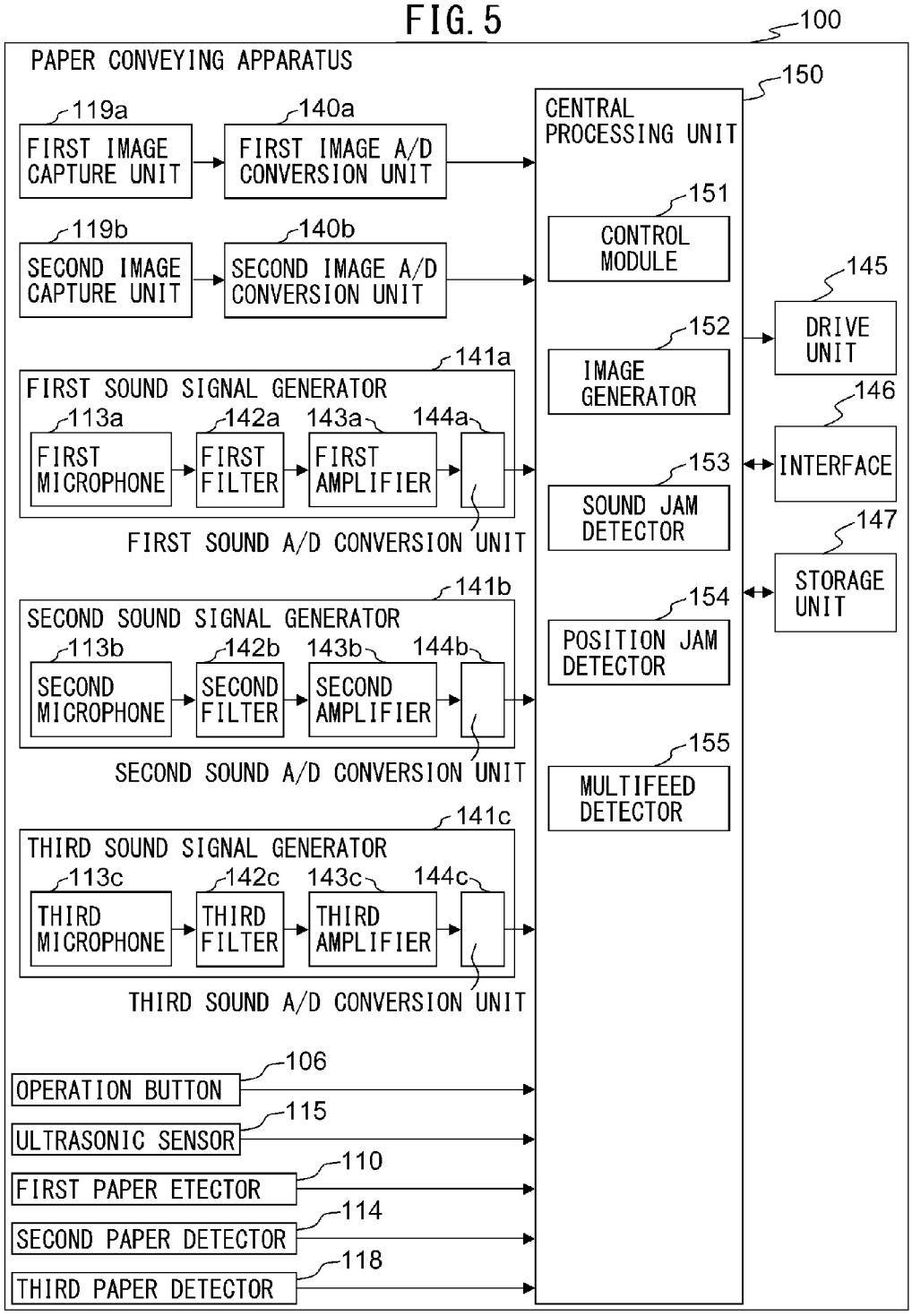
FIG. 5 is an example of a block diagram which shows the general configuration of a paper conveying apparatus 100.

FIG. 5 is an example of a block diagram which shows the general configuration of a paper conveying apparatus 100.

The paper conveying apparatus 100, in addition to the above-mentioned configuration, further has a first image A/D conversion unit 140*a*, a second image A/D conversion unit 140*b*, a first sound signal generator 141*a*, a second sound signal generator 141*b*, a third sound signal generator 141*c*, a drive unit 145, an interface 146, a storage unit 147, a central processing unit 150, etc.

The first image A/D conversion unit 140*a* converts an analog image signal which is output from the first image capture unit 119*a* from an analog to digital format to generate digital image data which it then outputs to the central processing unit 150. Similarly, the second image A/D conversion unit 140*b* converts the analog image signal which is output from the second image capture unit 119*b* from an analog to digital format to generate digital image data which it then outputs to the central processing unit 150. Below, these digital image data will be referred to as the "read image".

A first sound signal generator 141*a* includes the first microphone 113*a*, the first filter 142*a*, the first amplifier 143*a*, the first sound A/D conversion unit 144*a*, etc., and generates a sub source signal. The first filter 142*a* filters the signal which is output from the first microphone 113*a* by a bandpass filter which passes a predetermined frequency band of the signal and outputs it to the first amplifier 143*a*. The first amplifier 143*a* amplifies the signal which is output from the first filter 142*a* and outputs it to the first sound A/D conversion unit 144*a*. The first sound A/D conversion unit 144*a* converts the analog signal which is output from the first amplifier 143*a* to a digital first source signal and outputs it to the central processing unit 150. Below, the signal which the first sound A/D conversion unit 144*a* outputs will be referred to as the "sub source signal".

A second sound signal generator 141*b* includes the second microphone 113*b*, the second filter 142*b*, the second amplifier 143*b*, the second sound A/D conversion unit 144*b*, etc., and generates a first main source signal. The second filter 142*b* filters the signal which is output from the second microphone 113*b* by a bandpass filter which passes a predetermined frequency band of the signal and outputs it to the second amplifier 143*b*. The second amplifier 143*b* amplifies the signal which is output from the second filter 142*b* and outputs it to the second sound A/D conversion unit 144*b*. The second sound A/D conversion unit 144*b* converts the analog signal which is output from the second amplifier 143*b* to a digital second source signal and outputs it to the central processing unit 150. Below, the signal which the second sound A/D conversion unit 144*b* outputs will be referred to as the "first main source signal".

A third sound signal generator 141*c* includes the third microphone 113*c*, the third filter 142*c*, the third amplifier 143*c*, the third sound A/D conversion unit 144*c*, etc., and generates a second main source signal. The third filter 142*c* filters the signal which is output from the third microphone 113*c* by a bandpass filter which passes a predetermined frequency band of the signal and outputs it to the third amplifier 143*c*. The third amplifier 143*c* amplifies the signal which is output from the third filter 142*c* and outputs it to the third sound A/D conversion unit 144*c*. The third sound A/D conversion unit 144*c* converts the analog signal which is output from the third amplifier 143*c* to a digital third source signal and outputs it to the central processing unit 150. Below, the signal which the third sound A/D conversion unit 144*c* outputs will be referred to as the "second main source signal".

The drive unit 145 includes one or more motors and uses control signals from the central processing unit 150 to rotate the paper feed roller 111, the retard roller 112, the first conveyor roller 116, and the second conveyor roller 121 and operate to convey a paper.

The interface 146 has, for example, a USB or other serial bus-based interface circuit and electrically connects with a not shown information processing apparatus (for example, personal computer, portable data terminal, etc.) to send and receive a read image and various types of information. Further, it is also possible to connect a flash memory etc., to the interface 146 so as to store the read image.

The storage unit 147 has a RAM (random access memory), ROM (read only memory), or other memory device, a hard disk or other fixed disk device, or flexible disk, optical disk, or other portable storage device. Further, the storage unit 147 stores a computer program, database, tables, etc., which are used in various processing of the paper conveying apparatus 100. The computer program may be installed on the storage unit 147 from a computer-readable, non-transitory medium such as a compact disk read only memory (CD-ROM), a digital versatile disk read only memory (DVD-ROM), or the like by using a well-known setup program or the like. Furthermore, the storage unit 147 stores the read image.

The central processing unit 150 is provided with a CPU (central processing unit) and operates based on a program which is stored in advance in the storage unit 147. Note that, the central processing unit 150 may also be comprised of a DSP (digital signal processor), LSI (large scale integrated circuit), ASIC (application specific integrated circuit), FPGA (field-programming gate array), etc.

The central processing unit 150 is connected to the operation button 106, first paper detector 110, second paper detector 114, ultrasonic sensor 115, third paper detector 118, first image capture unit 119*a*, second image capture unit 119*b*, first image A/D conversion unit 140*a*, second image A/D conversion unit 140*b*, first sound signal generator 141*a*, second sound signal generator 141*b*, third sound signal generator 141*c*, drive unit 145, interface 146, and storage unit 147 and controls these parts.

The central processing unit 150 control a drive operation of the drive unit 145, control a paper read operation of the image capture unit 119, etc., to acquire a read image. Further, the central processing unit 150 has a control module 151, an image generator 152, a sound jam detector 153, a position jam detector 154, a multifeed detector 155, etc. These units are functional modules which are realized by software which operate on a processor. Note that, these units may be comprised of respectively independent integrated circuits, a microprocessor, firmware, etc.

Figure 6:
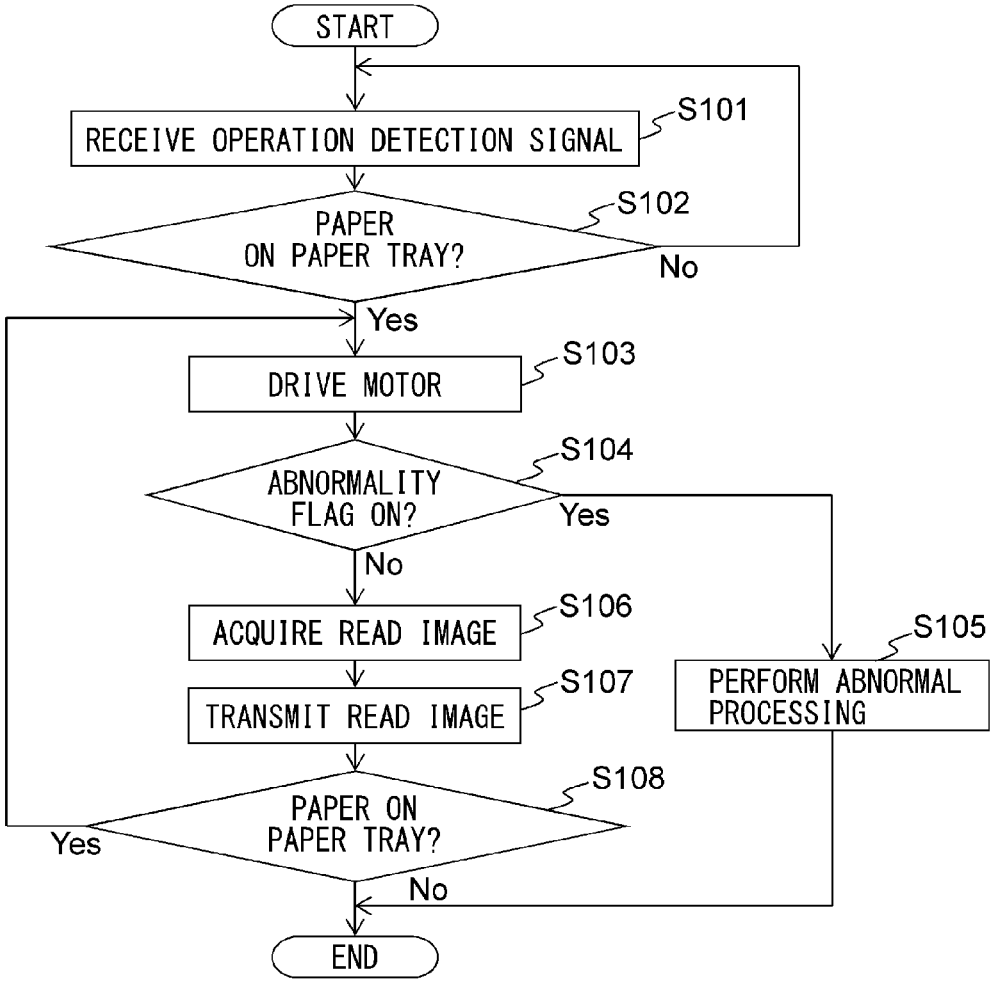
FIG. 6 is a flow chart which shows an example of operation of overall processing of a paper conveying apparatus 100.

FIG. 6 is a flow chart which shows an example of operation of overall processing of the paper conveying apparatus 100.

Below, referring to the flow chart which is shown in FIG. 6, an example of the operation of the overall processing of the paper conveying apparatus 100 will be explained. Note that, the flow of the operation which is explained below is performed based on a program which is stored in advance in the storage unit 147 mainly by the central processing unit 150 in cooperation with the elements of the paper conveying apparatus 100.

First, the central processing unit 150 stands by until a user pushes the operation button 106 and an operation detection signal is received from the operation button 106 (step S101).

Next, the central processing unit 150 determines whether the paper tray 103 has a paper placed on it based on the first paper detection signal which was received from the first paper detector 110 (step S102).

If the paper tray 103 does not have a paper placed on it, the central processing unit 150 returns the processing to step S101 and stands by until newly receiving an operation detection signal from the operation button 106.

On the other hand, when the paper tray 103 has a paper placed on it, the central processing unit 150 drives the drive unit 145 to rotate the paper feed roller 111, retard roller 112, first conveyor roller 116, and second conveyor roller 121 and convey the paper (step S103).

Next, the control module 151 determines whether an abnormality flag is ON or not (step S104). This abnormality flag is set OFF at the time of startup of the paper conveying apparatus 100 and is set ON if a later explained abnormality detection processing determines that an abnormality has occurred.

When the abnormality flag is ON, the control module 151, as an abnormal processing, stops the drive unit 145 to stop the conveyance of the paper, uses a not shown speaker, LED (light emitting diode), etc. to notify the user of the occurrence of an abnormality, sets the abnormality flag OFF (step S105), and ends the series of steps.

On the other hand, when the abnormality flag is not ON, the image generator 152 makes the first image capture unit 120*a* and the second image capture unit 120*b* read the conveyed paper and acquires the read image through the first image A/D conversion unit 140*a* and the second image A/D conversion unit 140*b* (step S106).

Next, the central processing unit 150 transmits the acquired read image through the interface 146 to a not shown information processing apparatus (step S107). Note that, when not connected to an information processing apparatus, the central processing unit 150 stores the acquired read image in the storage unit 147.

Next, the central processing unit 150 determines whether the paper tray 103 has a paper remaining thereon based on the first paper detection signal which was received from the first paper detector 110 (step S108).

When the paper tray 103 has a paper remaining thereon, the central processing unit 150 returns the processing to step S103 and repeats the processing of steps S103 to S108. On the other hand, when the paper tray 103 does not have any paper remaining thereon, the central processing unit 150 ends the series of processing.

Figure 7:
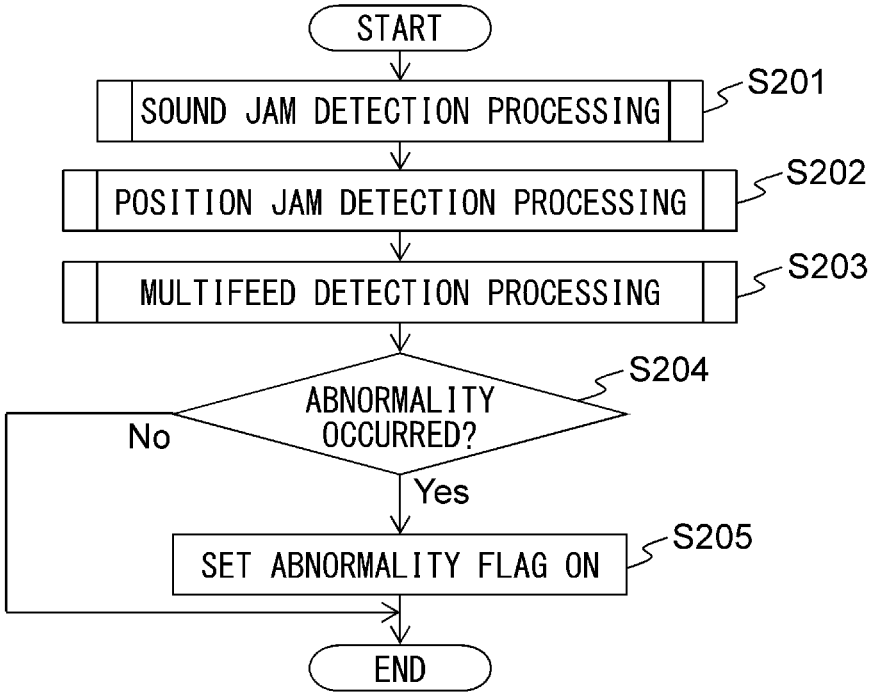
FIG. 7 is a flow chart which shows an example of an abnormality detection of the paper conveyance.

FIG. 7 is a flow chart which shows an example of an abnormality detection of the paper conveyance of the paper conveying apparatus 100.

The flow of operation which is explained below is executed based on a program which is stored in advance in the storage unit 147 mainly by the central processing unit 150 in cooperation with the elements of the paper conveying apparatus 100.

First, the sound jam detector 153 executes sound jam detection processing (step S201). The sound jam detector 153 determines whether a jam has occurred in sound jam detection processing based on a difference between the sub source signal which is acquired from the first sound signal generator 141*a* and the second main source signal which is acquired from the second sound signal generator 141*b* and a difference between the sub source signal and the third main source signal which is acquired from the third sound signal generator 141*c*. Below, sometimes a jam which is determined to exist by the sound jam detector 153 based on a sound signal will be called a "sound jam". Details of the sound jam detection processing will be explained later.

Next, the position jam detector 154 performs position jam detection processing (step S202). In the position jam detection processing, the position jam detector 154 determines the occurrence of a jam based on the second paper detection signal which is acquired from the second paper detector 114 and the third paper detection signal which is acquired from the third paper detector 118. Below, sometimes a jam which is determined to exist by the position jam detector 154 based on the second paper detection signal and third paper detection signal will be called a "position jam". Details of the position jam detection processing will be explained later.

Next, the multifeed detector 155 performs multifeed detection processing (step S203). In the multifeed detection processing, the multifeed detector 155 determines the occurrence of a multifeed of papers based on the ultrasonic signal which was acquired from the ultrasonic sensor 115. Details of the multifeed detection processing will be explained later.

Next, the control module 151 determines whether an abnormality has occurred in the paper conveyance processing (step S204). The control module 151 determines that an abnormality has occurred if at least one of a sound jam, position jam, and paper multifeed has occurred. That is, it is determined that no abnormality has occurred when none of a sound jam, position jam, or paper multifeed has occurred.

The control module 151 sets the abnormality flag to ON (step S205) and ends the series of steps when an abnormality occurs in the paper conveyance processing. On the other hand, when no abnormality occurs in the paper conveyance processing, it ends the series of steps without particularly performing any further processing. Note that, the flow chart which is shown in FIG. 5 is repeatedly executed every predetermined time interval.

Figure 8:
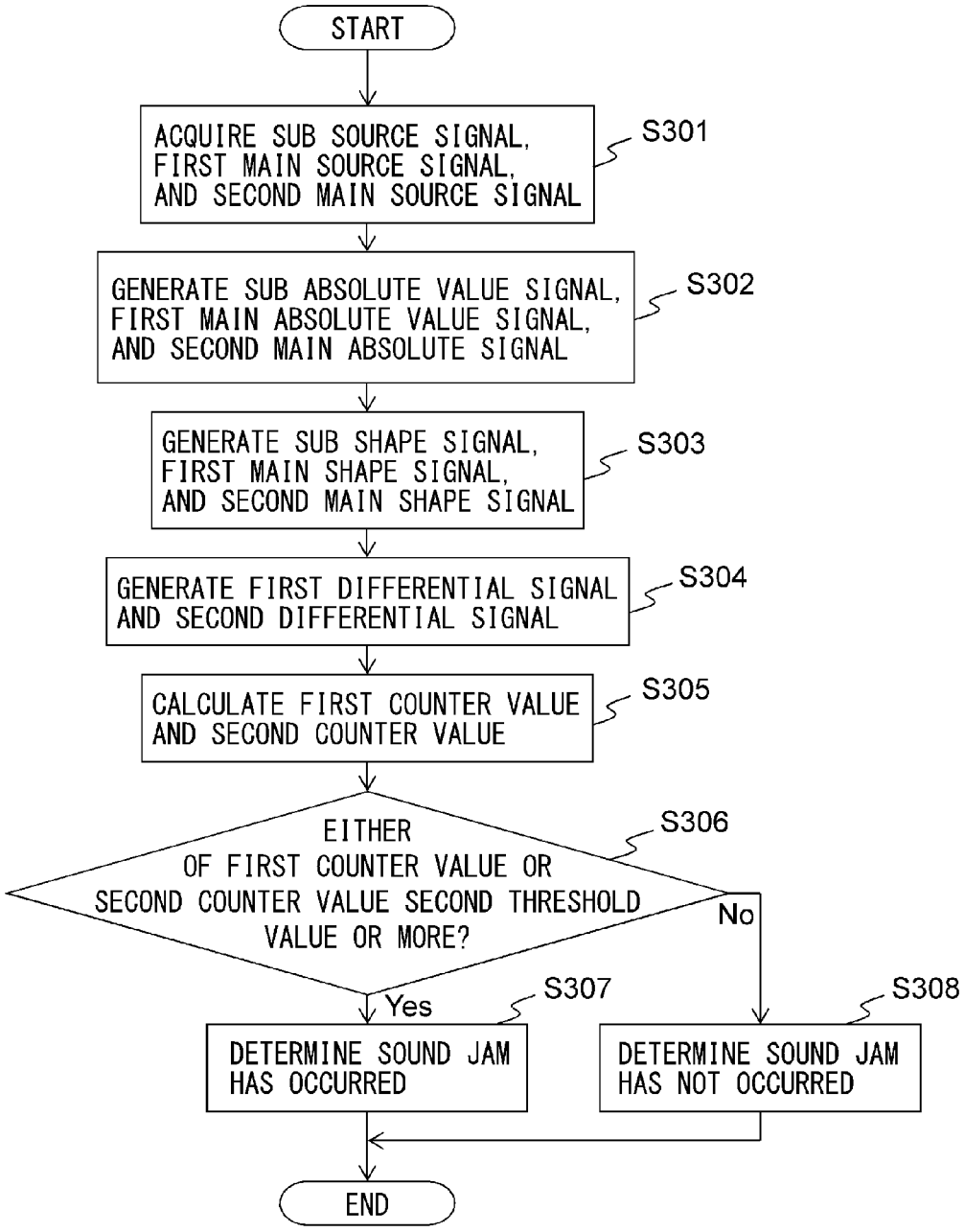
FIG. 8 is a flow chart which shows an example of operation of a sound jam detection processing.

FIG. 8 is a flow chart which shows an example of operation of a sound jam detection processing.

The flow of operation which is shown in FIG. 8 is executed at step S201 of the flow chart which is shown in FIG. 7.

First, the sound jam detector 153 acquires the sub source signal from the first sound signal generator 141*a*, acquires the first main source signal from the second sound signal generator 141*b*, and acquires the second main source signal from the third sound signal generator 141*c* (step S301).

Next, the sound jam detector 153 generates a sub absolute value signal of the absolute value of the sub source signal, a first main absolute value signal of the absolute value of the first main source signal, and a second main absolute value signal of the absolute value of the second main source signal (step S302).

Next, the sound jam detector 153 generates a sub shape signal which is a shape extracted from the sub absolute value signal, a first main shape signal which is a shape extracted from the first main absolute value signal, and a second main shape signal which is a shape extracted from the second main absolute value signal (step S303). The sound jam detector 153 generates signals of the peak hold for the sub absolute value signal, first main absolute value signal, and second main absolute value signal as the sub shape signal, first main shape signal, and second main shape signal. The sound jam detector 153 generates shape signals by holding the local maximum values of the absolute value signals for exactly certain hold periods and then attenuating them by certain attenuation rates.

Next, the sound jam detector 153 generates a first differential signal which shows the difference of the first main shape signal and the sub shape signal and a second differential signal which shows the difference of the second main shape signal and the sub shape signal (step S304). The sound jam detector 153 calculates the differences of the signal values of the first main shape signal and the sub shape signal at the same times and generates a signal comprised of these calculated differences arranged in time order as a first differential signal. Note that, when the difference of the signal values takes a negative value of less than 0, the difference of the signal values is made "0". Similarly, the sound jam detector 153 calculates the differences of the signal values of the second main shape signal and the sub shape signal at the same times and generates a signal comprised of these calculated differences arranged in time order as a second differential signal.

Next, the sound jam detector 153 calculates a first counter value which it increases when the signal value of the first differential signal is a first threshold value Th1 or more and which it decreases when it is less than the first threshold value Th1. Similarly, the sound jam detector 153 calculates a second counter value which it increases when the signal value of the second differential signal is the first threshold value Th1 or more and which it decreases when it is less than the first threshold value (step S305).

The sound jam detector 153 determines whether the signal value of the first differential signal is the first threshold value Th1 or more at every predetermined time interval (for example, sampling interval of the sound signal), increments the first counter value when the signal value of the first differential signal is the first threshold value Th1 or more, and decrements the first counter value when it is less than the first threshold value Th1. Similarly, the sound jam detector 153 determines whether the signal value of the second differential signal is the first threshold value Th1 or more at every predetermined time interval, increments the second counter value when the signal value of the second differential signal is the first threshold value Th1 or more, and decrements the second counter value when it is less than the first threshold value Th1.

Next, the sound jam detector 153 determines whether at least one of the first counter value and second counter value is a second threshold value Th2 or more (step S306). The sound jam detector 153 determines that a sound jam has occurred if at least one of the first counter value and second counter value is the second threshold value Th2 or more (step S307). On the other hand, the sound jam detector 153 determines that no sound jam has occurred, then ends the series of steps if both of the first counter value and second counter value are less than the second threshold value Th2 (step S308).

The sound jam detector 153 determines whether a jam has occurred based on the difference acquired by subtracting the sub shape signals respectively from the first main shape signal and second main shape signal. That is, the sound jam detector 153 determines whether a jam has occurred based on the first main shape signal and second main shape signal according to a detection method, and changes the detection method of a jam based on the sub shape signal.

Note that, the first sound signal generator 141*a* is not limited to the configuration which is shown in FIG. 5. The first sound signal generator 141*a* may be provided with only the first microphone 113*a*, while the first filter 142*a*, first amplifier 143*a*, and first sound A/D conversion unit 144*a* may be provided at the outside of the first sound signal generator 141*a*. Further, the first sound signal generator 141*a* may be provided with only the first microphone 113*a* and first filter 142*a* or only the first microphone 113*a*, first filter 142*a*, and first amplifier 143*a*. Furthermore, the first sound signal generator 141*a* may also be provided with, in addition to the parts which are shown in FIG. 5, an absolute value signal generator which generates a first absolute value signal from the first source signal. Furthermore, the first sound signal generator 141*a* may also be provided with, in addition to the parts which are shown in FIG. 5, an absolute value signal generator which generates a sub absolute value signal from the sub source signal and a shape signal generator which generates a sub shape signal from a sub absolute value signal.

Similarly, the second sound signal generator 141*b* is not limited to the configuration which is shown in FIG. 5. The second sound signal generator 141*b* may be provided with only the second microphone 113*b*, while the second filter 142*b*, second amplifier 143*b*, and second sound A/D conversion unit 144*b* may be provided at the outside of the second sound signal generator 141*b*. Further, the second sound signal generator 141*b* may be provided with only the second microphone 113*b* and second filter 142*b* or only the second microphone 113*b*, second filter 142*b*, and second amplifier 143*b*. Furthermore, the second sound signal generator 141*b* may also be provided with, in addition to the parts which are shown in FIG. 5, an absolute value signal generator which generates a second absolute value signal from the second source signal. Furthermore, the second sound signal generator 141*b* may also be provided with, in addition to the parts which are shown in FIG. 5, an absolute value signal generator which generates a main absolute value signal from the first main source signal and a shape signal generator which generates a first main shape signal from a main absolute value signal.

Similarly, the third sound signal generator 141*c* is not limited to the configuration which is shown in FIG. 5. The third sound signal generator 141*c* may be provided with only the third microphone 113*c*, while the third filter 142*c*, third amplifier 143*c*, and third sound A/D conversion unit 144*c* may be provided at the outside of the third sound signal generator 141*c*. Further, the third sound signal generator 141*c* may be provided with only the third microphone 113*c* and third filter 142*c* or only the third microphone 113*c*, third filter 142*c*, and third amplifier 143*c*. Furthermore, the third sound signal generator 141*c* may also be provided with, in addition to the parts which are shown in FIG. 5, an absolute value signal generator which generates a second main absolute value signal from the second main source signal. Furthermore, the third sound signal generator 141*c* may also be provided with, in addition to the parts which are shown in FIG. 5, an absolute value signal generator which generates a second main absolute value signal from the second main source signal and a shape signal generator which generates a second main shape signal from a second main absolute value signal.

Further, the sound jam detector 153 may also determine whether a jam has occurred based on the difference acquired by subtracting the signal which the first microphone 113*a* outputs from the signal which the second microphone 113*b* outputs and the difference acquired by subtracting the signal which the first microphone 113*a* outputs from the signal which the third microphone 113*c* outputs. In this case, it processes the differential signal acquired by subtracting the signal which the first microphone 113*a* outputs from the signal which the second microphone 113*b* outputs by applying a predetermined bandpass filter, amplification, and conversion to a digital format and extracts the shape for utilization for detection of a jam. Similarly, it processes the differential signal acquired by subtracting the signal which the first microphone 113*a* outputs from the signal which the third microphone 113*c* outputs by applying a predetermined bandpass filter, amplification, and conversion to a digital format and extracts the shape for utilization for detection of a jam.

Further, the sound jam detector 153 may also determine whether a jam has occurred based on the difference acquired by subtracting the signal which the first filter 142*a* outputs from the signal which the second filter 142*b* outputs and the difference acquired by subtracting the signal which the first filter 142*a* outputs from the signal which the third filter 142*c* outputs. In this case, it amplifies and converts to a digital format the differential signal acquired by subtracting the signal which the first filter 142*a* outputs from the signal which the second filter 142*b* outputs and extracts the shape for utilization for detection of a jam. Similarly, it amplifies and converts to a digital format the differential signal acquired by subtracting the signal which the first filter 142*a* outputs from the signal which the third filter 142*c* outputs and extracts the shape for utilization for detection of a jam.

Further, the sound jam detector 153 may also determine whether a jam has occurred based on the difference acquired by subtracting the signal which the first amplifier 143*a* outputs from the signal which the second amplifier 143*b* outputs and the difference acquired by subtracting the signal which the first amplifier 143*a* outputs from the signal which the third amplifier 143*c* outputs. In this case, it converts to a digital format the differential signal acquired by subtracting the signal which the first amplifier 143*a* outputs from the signal which the second amplifier 143*b* outputs and extracts the shape for utilization for detection of a jam. Similarly, it converts to a digital format the differential signal acquired by subtracting the signal which the first amplifier 143*a* outputs from the signal which the third amplifier 143*c* outputs and extracts the shape for utilization for detection of a jam.

Further, the sound jam detector 153 may also determine whether a jam has occurred based on the difference acquired by subtracting the sub source signal from the first main source signal and the difference acquired by subtracting the sub source signal from the second main source signal. In this case, the sound jam detector 153 extracts the shape of the differential signal acquired by subtracting the sub source signal from the first main source signal for utilization for detection of a jam. Similarly, the sound jam detector 153 extracts the shape of the differential signal acquired by subtracting the sub source signal from the second main source signal for utilization for detection of a jam.

Further, the sound jam detector 153 may also determine whether a jam has occurred based on the difference acquired by subtracting the sub absolute value signal from the first main absolute value signal and the difference acquired by subtracting the sub absolute value signal from the second main absolute value signal. In this case, the sound jam detector 153 extracts the shape of the differential signal acquired by subtracting the sub absolute value signal from the first main absolute value signal for utilization for detection of a jam. Similarly, the sound jam detector 153 extracts the shape of the differential signal acquired by subtracting the sub absolute value signal from the second main absolute value signal for utilization for detection of a jam.

Below, the significance of changing the detection method of a jam based on a sub shape signal will be explained.

Figure 9:
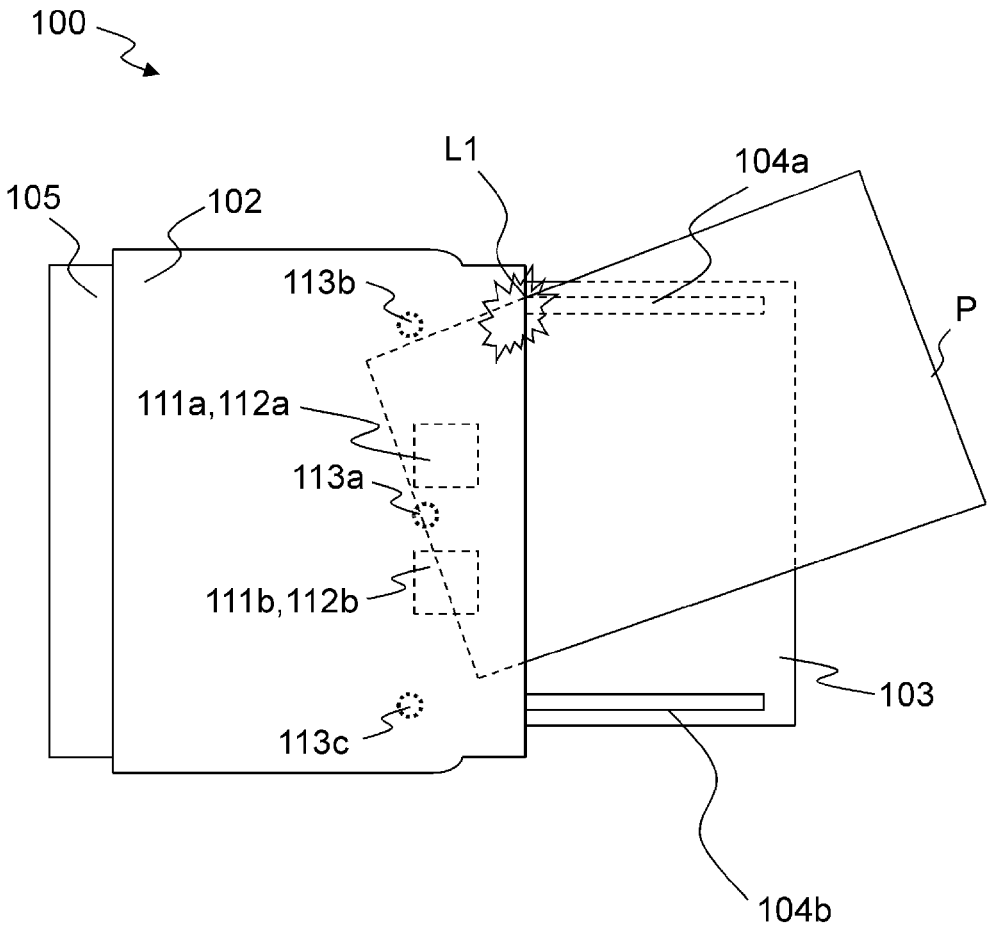
FIG. 9 is a view for explaining a skew jam.

FIG. 9 is a view for explaining a skew jam.

As shown in FIG. 9, if the paper P is conveyed at a skew with respect to the paper conveyance direction, the rear end of the paper P ends up riding over the side guides 104*a* on the paper tray 103. Furthermore, if the paper P is conveyed, at the position L1 near the position where the lower housing 101 and the paper tray 103 engage, the end of the paper P hits the side walls of the conveyance path of the paper and a large sound is generated. The jam which is caused as a result of a paper being conveyed at a skew in this way is called a "skew jam".

Figure 10:
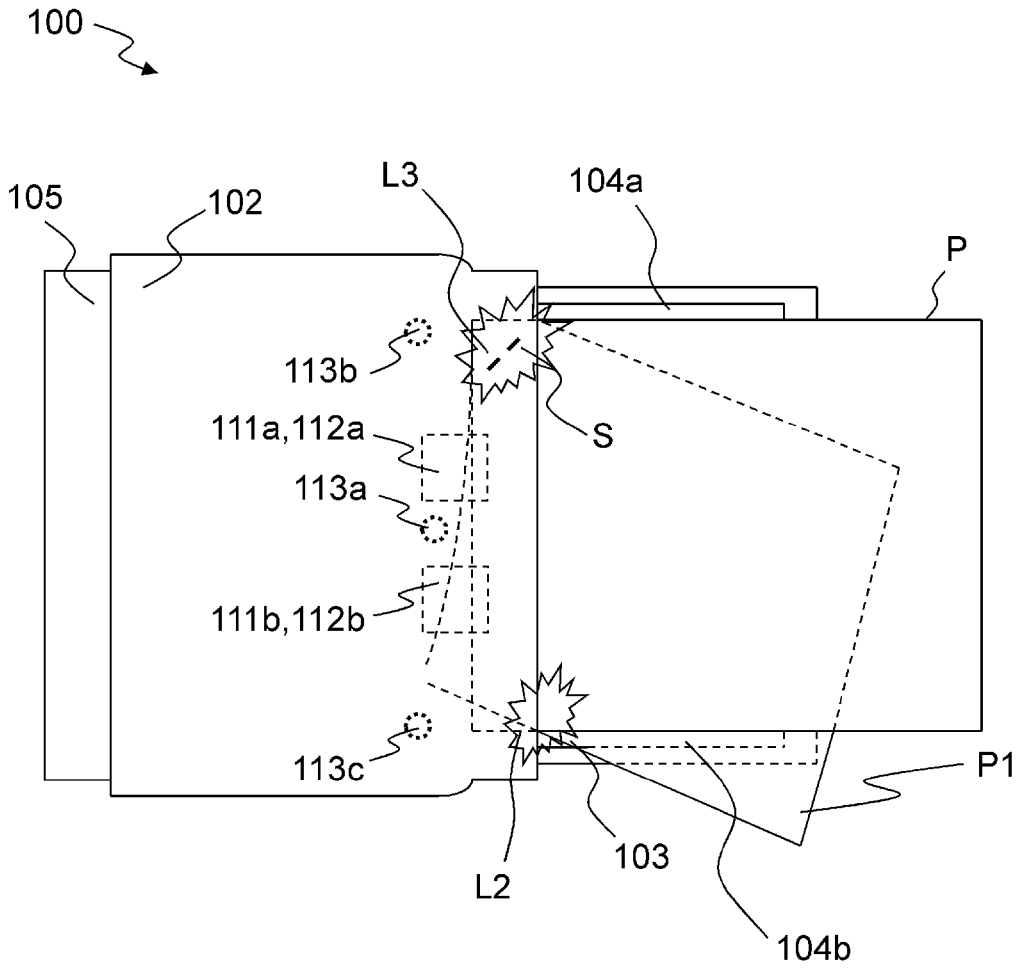
FIG. 10 is a view for explaining a staple jam.
Figure 11:
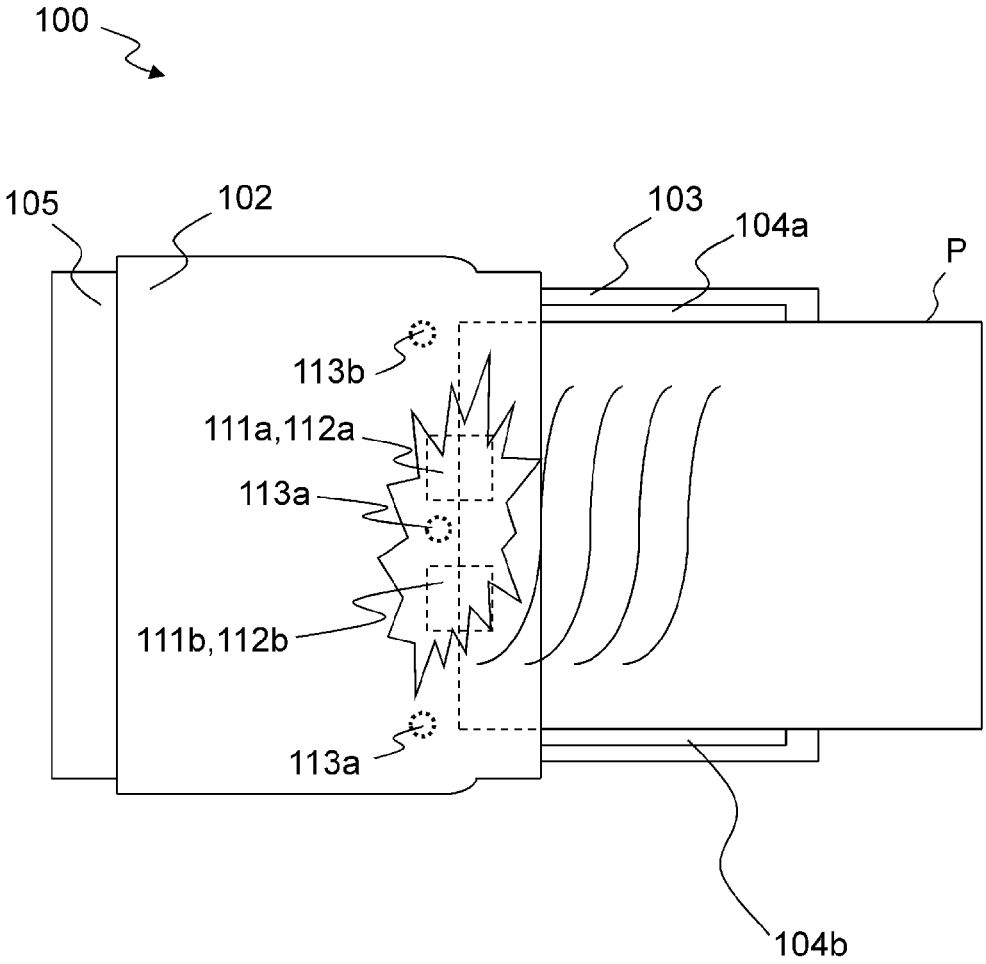
FIG. 11 is a view for explaining the case where a paper which has a wrinkle is conveyed.

FIG. 10 is a view for explaining a staple jam.

FIG. 10 shows an example of the case where a paper P which is fastened by a staple S is conveyed with its fastened part toward the downstream side. When a plurality of sheets of paper are fastened by a staple, in general one of the four corners of the paper is fastened. If the paper P which is fastened by the staple S is conveyed by the paper conveying apparatus 100 with its fastened part toward the downstream side, the paper feed rollers 111 and the retard rollers 112 will attempt to convey only the sheet of paper P1 which contacts the paper feed rollers 111 in the paper P. However, the sheets other than the paper P1 are fastened by the staple S, so this is not conveyed.

Therefore, the paper P1 pivots about the staple S, and the back end of the paper P1 ends up riding over the side guide 104*b* on the paper tray 103. If the paper P1 pivots further, the end part of the paper P1 strikes the side wall of the conveyance path of the paper at a position L2 near the position where the lower housing 101 and the paper tray 103 are engaged, and a loud sound is generated. Further, the paper P1 becomes twisted or wrinkled even at the position L3 around the part which is fastened by the staple S, and a loud sound is generated. A jam which occurs in this way as a result of a paper which has been fastened by a staple being conveyed is called a "staple jam".

FIG. 10 is a view for explaining the case where a paper which has a wrinkle is conveyed.

As shown in FIG. 10, if a paper P which has a wrinkle is conveyed, when the paper P passes between the paper feed rollers 111 and the retard rollers 112, even if a jam does not occur, the wrinkle causes a large sound to be generated. The first microphone 113*a*, second microphone 113*b* and third microphone 113*c* detects this sound which is generated by the wrinkle.

In particular, the first microphone 113*a* which is arranged near the paper feed rollers 111 and retard rollers 112 detects the sound which is generated by a wrinkle as a loud sound. On the other hand, the second microphone 113*b* and third microphone 113*c* are arranged at positions separated from the paper feed rollers 111 and retard rollers 112, so do not detect the sound which is generated by a wrinkle as loud as by the first microphone 113*a*.

FIG. 12 gives graphs which show examples of signals for detection of a sound jam in the case where a paper which has a wrinkle is conveyed.

Figure 12A:
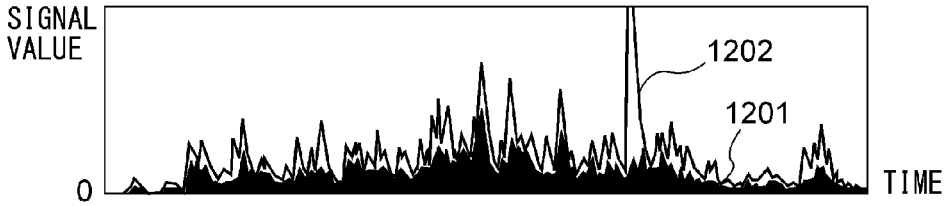
FIG. 12A is a graph which shows an example of a first main shape signal for a paper which has a wrinkle.
Figure 12B:
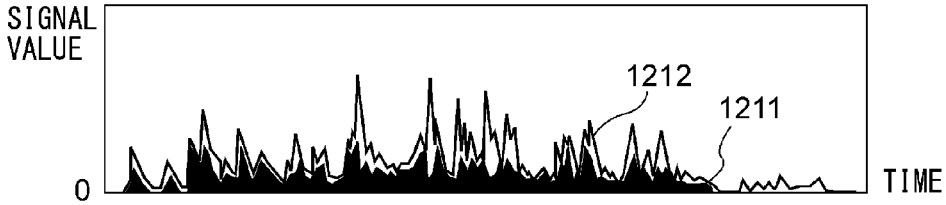
FIG. 12B is a graph which shows an example of a sub shape signal for a paper which has a wrinkle.
Figure 12C:
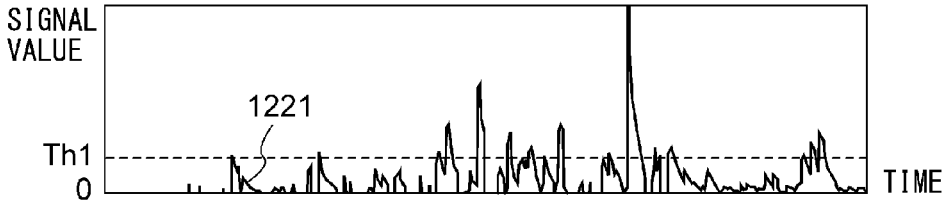
FIG. 12C is a graph which shows an example of a first differential signal for a paper which has a wrinkle.
Figure 12D:
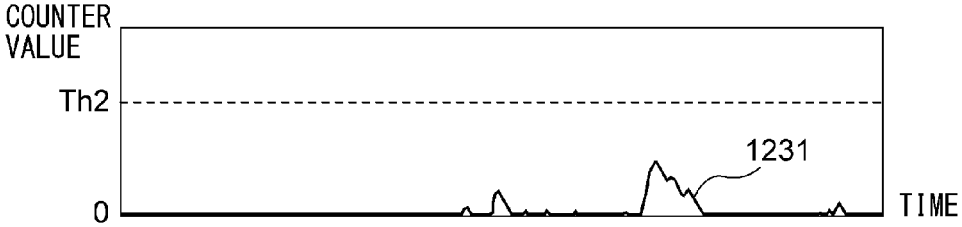
FIG. 12D is a graph which shows an example of a first counter value for a paper which has a wrinkle.

The abscissas of FIG. 12A, FIG. 12B, FIG. 12C, and FIG. 12D show the time, the ordinates of FIG. 12A, FIG. 12B, and FIG. 12C show the signal value, and the ordinate of FIG. 12D shows the counter value. The graph of FIG. 12A shows an example of a first main absolute value signal 1201 in the case where a paper which has a wrinkle is conveyed and a first main shape signal 1202 which is generated from the first main absolute value signal 1201 (see FIG. 8, step S302, S303). The graph of FIG. 12B shows an example of a sub absolute value signal 1211 in the case where a paper which has a wrinkle is conveyed and a sub shape signal 1212 which is generated from the sub absolute value signal 1211 (see FIG. 8, step S302, S303). The graph of FIG. 12C shows an example of a first differential signal 1221 which is generated from the first main shape signal 1202 and the sub shape signal 1212 (see FIG. 8, step S304). The graph of FIG. 12D shows an example of a first counter value 1231 which is calculated for the first differential signal 1221 (see FIG. 8, step S305).

As shown in FIG. 12A and FIG. 12B, compared with the first main shape signal 1202 based on the sound which the second microphone 113*b* detects, the sub shape signal 1212 based on the sound which the first microphone 113*a* detects has a certain degree of magnitude. As shown in FIG. 12C, the signal value of the first differential signal 1221 frequently does not become the first threshold value Th1 or more. Therefore, as shown in FIG. 12D, the first counter value 1231 does not become the second threshold value Th2 or more and it is not determined that a sound jam has occurred in a case where a paper which has a wrinkle is conveyed.

The first differential signal 1221 is generated by subtracting the sub shape signal 1212 from the first main shape signal 1202, so becomes a signal from which the component of sound which is generated due to the wrinkle of the paper is substantially removed. Similarly, the second differential signal is generated by subtracting the sub shape signal from the second main shape signal, so becomes a signal from which the component of sound which is generated due to the wrinkle of the paper is substantially removed. Here, "the component of sound which is generated due to the wrinkle of the paper" means, in the signal value of the signal based on the sound which the second microphone 113*b* or third microphone 113*c* detects, the component which becomes higher due to the sound which is generated when a paper which has a wrinkle passes between the paper feed rollers 111 and the retard rollers 112. "A signal from which the component of sound which is generated due to the wrinkle of the paper is substantially removed" means a signal acquired by reducing the effect due to the sound which is generated by the wrinkle of the paper from the signal based on the sound which the second microphone 113*b* or third microphone 113*c* detects. The sound jam detector 153 determines any occurrence of a jam based on the differential signal "from which the component of sound which is generated due to the wrinkle of the paper is substantially removed", so it is possible to suppress erroneous detection of a jam which occurs due to a wrinkle of a paper.

Figure 13:
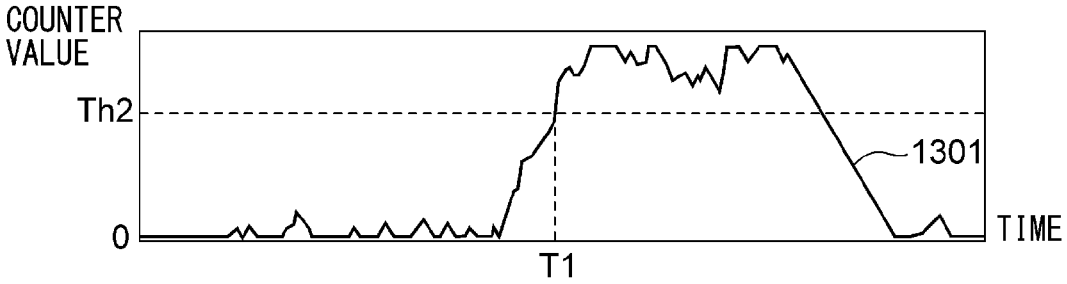
FIG. 13 is a graph which shows a counter value for a signal of FIG. 12A.

FIG. 13 is a graph which shows a counter value 1301 which is calculated for the first main shape signal 1202 of FIG. 12A.

The abscissa of FIG. 13 shows the time, while the ordinate shows the counter value. In FIG. 13, the counter value 1301 is calculated to increase when the first main shape signal 1202 is the first threshold value Th1 or more and to decrease when it is less than the first threshold value Th1. As shown in FIG. 13, the counter value 1301 which is calculated for the first main shape signal 1202 becomes the second threshold value Th2 at the time T1. That is, if determining the occurrence of a jam based on just one of the sound which the second microphone 113*b* detects and the sound which the third microphone 113*c* detects, there is a possibility of erroneously determining the occurrence of a jam due to the sound which is generated by a wrinkle of a paper.

FIG. 14 gives graphs which show examples of signals for detection of a sound jam in a case where a paper which does not have a wrinkle is conveyed and a skew jam which is shown in FIG. 9 occurs.

Figure 14A:
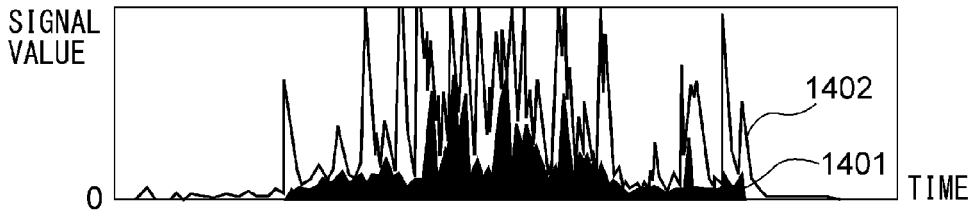
FIG. 14A is a graph which shows an example of a first main shape signal at the time of occurrence of a skew jam.
Figure 14B:
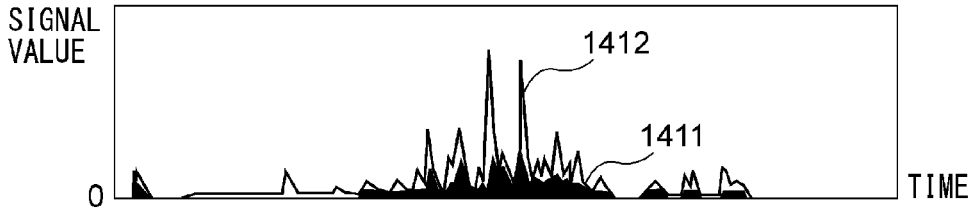
FIG. 14B is a graph which shows an example of a sub shape signal at the time of occurrence of a skew jam.
Figure 14C:
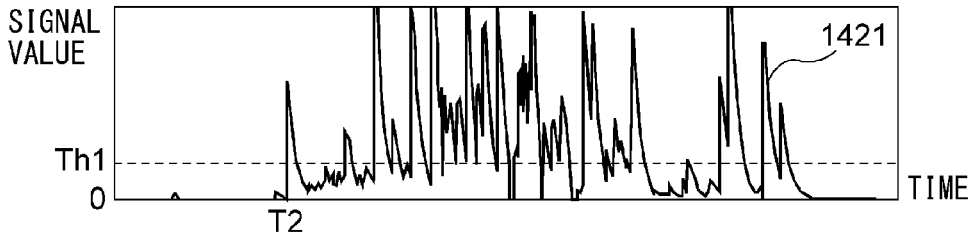
FIG. 14C is a graph which shows an example of a first differential signal at the time of occurrence of a skew jam.
Figure 14D:
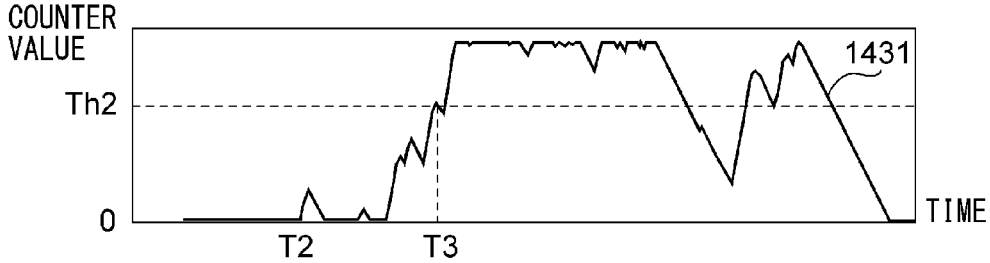
FIG. 14D is a graph which shows an example of a first counter value at the time of occurrence of a skew jam.

The abscissas of FIG. 14A, FIG. 14B, FIG. 14C, and FIG. 14D show the time, the ordinates of FIG. 14A, FIG. 14B, and FIG. 14C show the signal value, and the ordinate of FIG. 14D shows the counter value. The graph of FIG. 14A shows an example of a first main absolute value signal 1401 in the case where a paper which does not have a wrinkle is conveyed and a skew jam occurs and a first main shape signal 1402 which is generated from the first main absolute value signal 1401. The graph of FIG. 14B shows an example of a sub absolute value signal 1411 in the case where a paper which does not have a wrinkle is conveyed and a skew jam occurs and a sub shape signal 1412 which is generated from the sub absolute value signal 1411. The graph of FIG. 14C shows an example of a first differential signal 1421 which is generated from the first main shape signal 1402 and the sub shape signal 1412. The graph of FIG. 14D shows an example of a first counter value 1431 which is calculated for the first differential signal 1421.

If the skew jam which is shown in FIG. 9 occurs, at the second microphone 113*b* near the position L1, the sound which is generated by the skew jam is detected well, but at the first microphone 113*a* which is separated from the position L1, the sound is not detected as loud as by the second microphone 113*b*.

Therefore, as shown in FIG. 14A and FIG. 14B, the first main shape signal 1402 based on the sound which the second microphone 113*b* detects takes a value larger overall than the sub shape signal 1412 based on the sound which the first microphone 113*a* detects. As shown in FIG. 14C, the signal value of the first differential shape signal 1421 becomes the first threshold value Th1 or more at the time T2 and, after that, frequently becomes the first threshold value Th1 or more. As shown in FIG. 14D, the first counter value 1431 increases from the time T2, then while repeatedly increasing and decreasing, becomes the second threshold value Th2 or more at the time T3 whereby it is determined that a sound jam has occurred.

FIG. 15 gives graphs which show examples of signals for detection of a sound jam in a case where a paper which does not have a wrinkle is conveyed and a staple jam which is shown in FIG. 10 occurs.

Figure 15A:
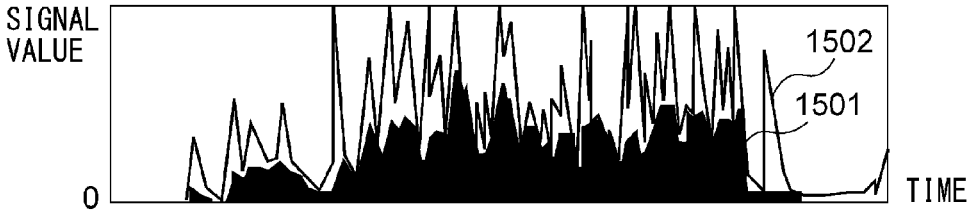
FIG. 15A is a graph which shows an example of a first main shape signal at the time of occurrence of a staple jam.
Figure 15B:
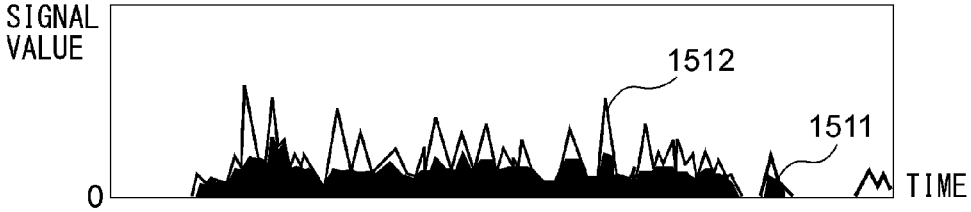
FIG. 15B is a graph which shows an example of a sub shape signal at the time of occurrence of a staple jam.
Figure 15C:
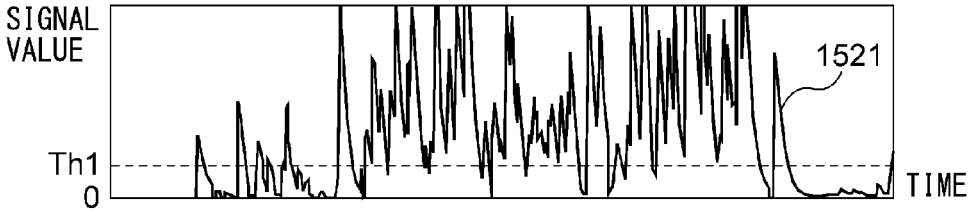
FIG. 15C is a graph which shows an example of a first differential signal at the time of occurrence of a staple jam.
Figure 15D:
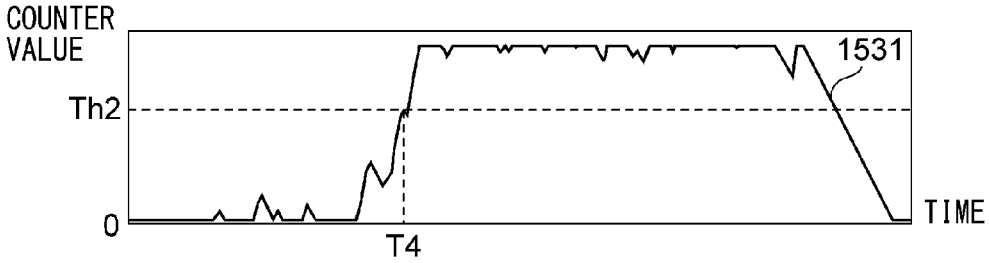
FIG. 15D is a graph which shows an example of a first counter value at the time of occurrence of a staple jam.

The abscissas of FIG. 15A, FIG. 15B, FIG. 15C, and FIG. 15D show the time, the ordinates of FIG. 15A, FIG. 15B, and FIG. 15C show the signal value, and the ordinate of FIG. 15D shows the counter value. The graph of FIG. 15A shows an example of a first main absolute value signal 1501 in the case where a staple jam has occurred and a first main shape signal 1502 which is generated from the first main absolute value signal 1501. The graph of FIG. 15B shows an example of a sub absolute value signal 1511 in the case where a staple jam has occurred and a sub shape signal 1512 which is generated from the sub absolute value signal 1511. The graph of FIG. 15C shows an example of a first differential signal 1521 which is generated from the first main shape signal 1502 and the sub shape signal 1512. The graph of FIG. 15D shows an example of a first counter value 1531 which is calculated for the first differential signal 1521.

If the staple jam which is shown in FIG. 10 occurs, at the third microphone 113*c* which is near the position L2 and the second microphone 113*b* which is near the position L3, the sound which is generated due to the staple jam is detected well. On the other hand, at the first microphone 113*a* which is separated from both the position L2 and the position L3, the sound which is generated due to the staple jam is not detected as loud as by the second microphone 113*b* and the third microphone 113*c*.

Therefore, as shown in FIG. 15A and FIG. 15B, the first main shape signal 1502 based on the sound which the second microphone 113*b* detects takes a value which is overall larger than the sub shape signal 1512 based on the sound which the first microphone 113*a* detects. As shown in FIG. 15C, the signal value of the first differential signal 1521 frequently becomes the first threshold value Th1 or more. As shown in FIG. 15D, the first counter value 1531 becomes the second threshold value Th2 or more at the time T4 whereby it is determined that a sound jam has occurred.

Note that, when a paper which has been folded into two is conveyed, the folded part acts in the same way as a part which is fastened by a staple resulting in the occurrence of a jam and causing a loud sound to be generated at the two ends of the conveyance path of the paper. For this reason, the paper conveying apparatus 100 can determine that a sound jam has occurred in the same way as the case where a staple jam has occurred even which a paper which has been folded into two is conveyed and a jam occurs.

FIG. 16 gives graphs which show examples of signals for detection of a sound jam in a case where a paper which has a wrinkle is conveyed and a skew jam occurs.

Figure 16A:
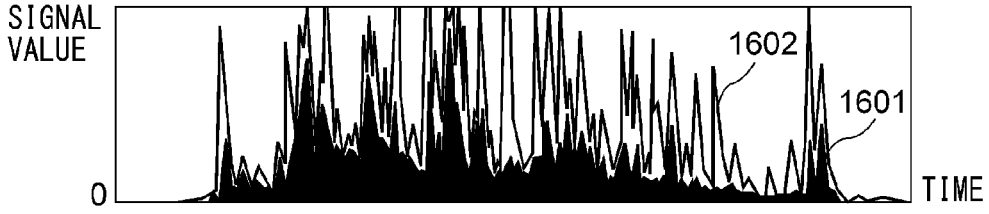
FIG. 16A is a graph which shows an example of a first main shape signal at the time of occurrence of a skew jam.
Figure 16B:
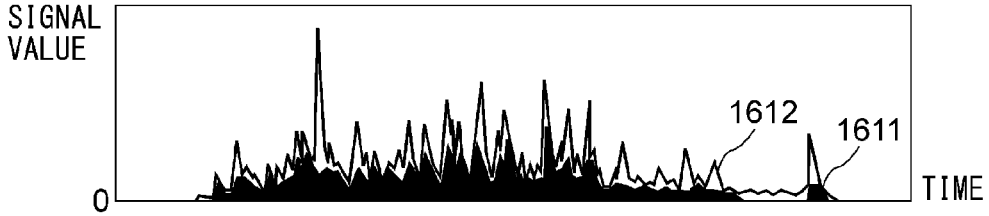
FIG. 16B is a graph which shows an example of a sub shape signal at the time of occurrence of a skew jam.
Figure 16C:
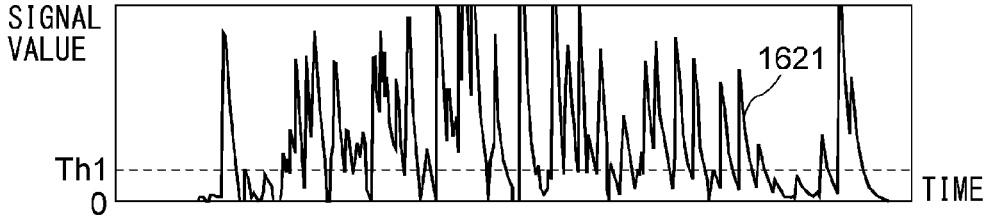
FIG. 16C is a graph which shows an example of a first differential signal at the time of occurrence of a skew jam.
Figure 16D:
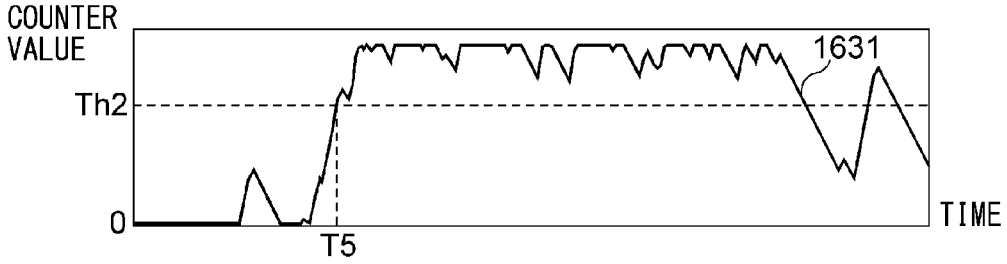
FIG. 16D is a graph which shows an example of a first differential signal at the time of occurrence of a skew jam.

The abscissas of FIG. 16A, FIG. 16B, FIG. 16C, and FIG. 16D show the time, the ordinates of FIG. 16A, FIG. 16B, and FIG. 16C show the signal value, and the ordinate of FIG. 16D shows the counter value. The graph of FIG. 16A shows an example of a first main absolute value signal 1601 in the case where a paper which has a wrinkle is conveyed and a skew jam occurs and a first main shape signal 1602 which is generated from the first main absolute value signal 1601. The graph of FIG. 16B shows an example of a sub absolute value signal 1611 in the case where a paper which has a wrinkle is conveyed and a skew jam occurs and a sub shape signal 1612 which is generated from the sub absolute value signal 1611. The graph of FIG. 16C shows an example of a first differential signal 1621 which is generated from the first main shape signal 1602 and the sub shape signal 1612. The graph of FIG. 16D shows an example of a first counter value 1631 which is calculated for the first differential signal 1621.

As shown in FIG. 16C, the first differential signal 1621 becomes smaller than the first main shape signal 1602 of FIG. 16A, since the sound which is generated due to the wrinkle of the paper is substantially removed. However, the sound which is generated due to a skew jam is sufficiently large, so, as shown in FIG. 16D, the counter value 1631 becomes the second threshold value Th2 or more at the time T5 whereby it is determined that a sound jam has occurred.

FIG. 17 gives graphs which show examples of signals for detection of a sound jam in a case where a paper which has a wrinkle is conveyed and a staple jam occurs.

Figure 17A:
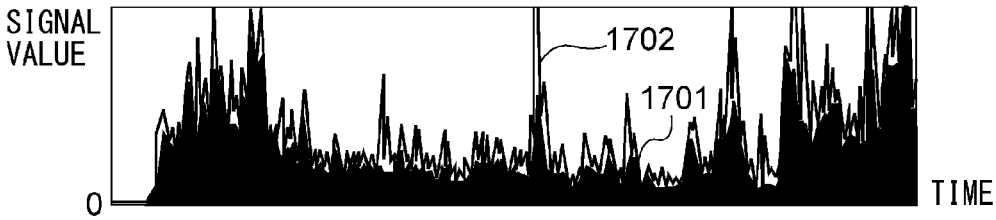
FIG. 17A is a graph which shows an example of a first main shape signal at the time of occurrence of a staple jam.
Figure 17B:
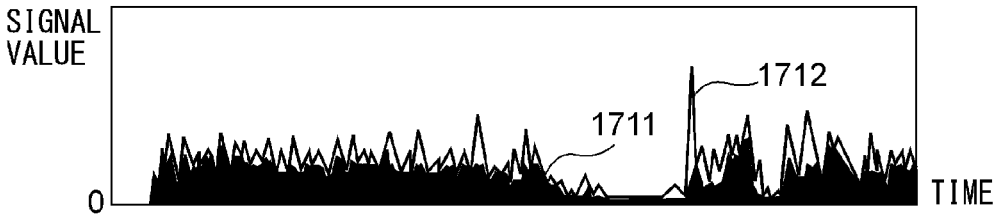
FIG. 17B is a graph which shows an example of a sub shape signal at the time of occurrence of a staple jam.
Figure 17C:
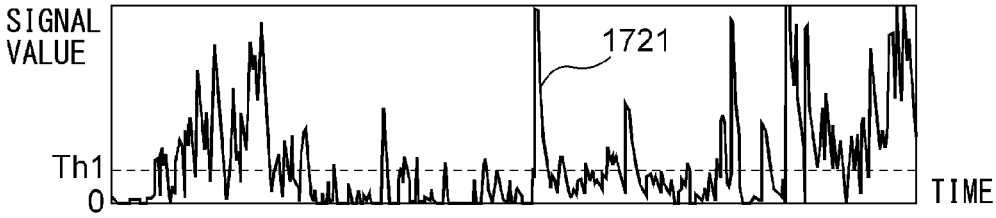
FIG. 17C is a graph which shows an example of a first differential signal at the time of occurrence of a staple jam.
Figure 17D:
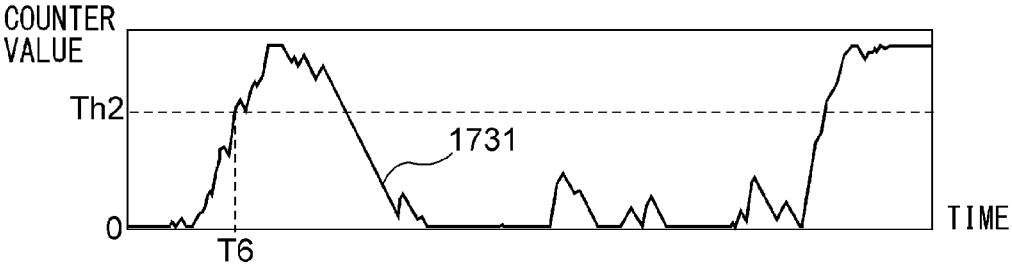
FIG. 17D is a graph which shows an example of a first counter value at the time of occurrence of a staple jam.

The abscissas of FIG. 17A, FIG. 17B, FIG. 17C, and FIG. 17D show the time, the ordinates of FIG. 17A, FIG. 17B, and FIG. 17C show the signal value, and the ordinate of FIG. 17D shows the counter value. The graph of FIG. 17A shows an example of a first main absolute value signal 1701 in the case where a paper which has a wrinkle is conveyed and a skew jam occurs and a first main shape signal 1702 which is generated from the first main absolute value signal 1701. The graph of FIG. 17B shows an example of a sub absolute value signal 1711 in the case where a paper which has a wrinkle is conveyed and a skew jam occurs and a sub shape signal 1712 which is generated from the sub absolute value signal 1711. The graph of FIG. 17C shows an example of a first differential signal 1721 which is generated from the first main shape signal 1702 and the sub shape signal 1712. The graph of FIG. 17D shows an example of a first counter value 1731 which is calculated for the first differential signal 1721.

As shown in FIG. 17C, the first differential signal 1721 becomes smaller than the first main shape signal 1702 of FIG. 17A, since the sound which is generated due to the wrinkle of the paper is substantially removed. However, the sound which is generated due to a staple jam is sufficiently large, so, as shown in FIG. 17D, the counter value 1731 becomes the second threshold value Th2 or more at the time T6 whereby it is determined that a sound jam has occurred.

In the above way, the sound jam detector 153 does not determine that a sound jam has occurred even in a case where a paper which has a wrinkle is conveyed if a skew jam and staple jam have not occurred. On the other hand, the sound jam detector 153 can determine that a sound jam has occurred when a skew jam or staple jam has occurred regardless if the paper has a wrinkle.

Note that, either of the second microphone 113*b* and third microphone 113*c* may be omitted and detection of a sound jam may be omitted for either of the first main source signal and second main source signal. As explained above, if a staple jam occurs, a loud sound is generated at the two ends of the conveyance path of the paper, so in this case as well, a staple jam can be accurately detected.

Figure 18:
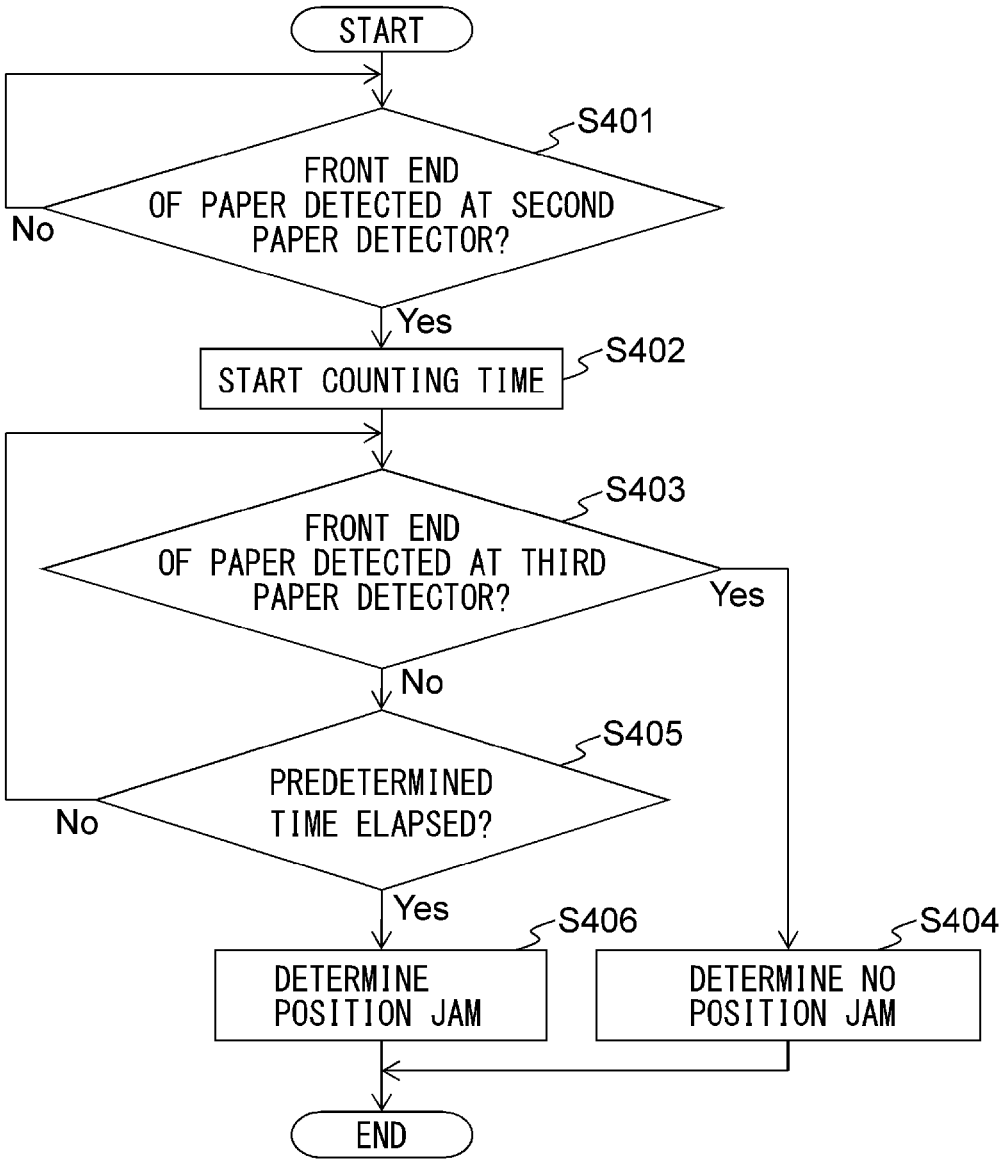
FIG. 18 is a flow chart which shows an example of operation of a position jam detection processing.

FIG. 18 is a flow chart which shows an example of operation of a position jam detection processing.

The flow of operation which is shown in FIG. 18 is executed at step S202 of the flow chart which is shown in FIG. 8.

First, the position jam detector 154 stands by until the front end of the paper is detected by the second paper detector 114 (step S401). The position jam detector 154 determines that the front end of the paper is detected at the position of the second paper detector 114, that is, downstream of the paper feed roller 111 and retard roller 112 and upstream of the first conveyor roller 116 and first driven roller 117, when the value of the second paper detection signal from the second paper detector 114 changes from a value which shows the state where there is no paper to a value which shows the state where there is one.

Next, when the second paper detector 114 detects the front end of a paper, the position jam detector 154 starts counting time (step S402).

Next, the position jam detector 154 determines whether the third paper detector 118 has detected the front end of the paper (step S403). The position jam detector 154 determines that the front end of the paper is detected at the position of the third paper detector 118, that is, downstream of the first conveyor roller 116 and first driven roller 117 and upstream of the image capture unit 119, when the value of the third paper detection signal from the third paper detector 118 changes from a value which shows the state where there is no paper to a value which shows the state where there is one.

When the third paper detector 118 detects the front end of a paper, the position jam detector 154 determines that no position jam has occurred (step S404) and ends the series of steps.

On the other hand, if the third paper detector 118 detects the front end of the paper, the position jam detector 154 determines whether a predetermined time (for example, 1 second) has elapsed from the start of counting time (step S405). If a predetermined time has not elapsed, the position jam detector 154 returns to the processing of step S403 and again determines whether the third paper detector 118 has detected the front end of the paper. On the other hand, when a predetermined time has elapsed, the position jam detector 154 determines that position jam has occurred (step S406) and ends the series of steps. Note that, when position jam detection processing is not required in the paper conveying apparatus 100, this may be omitted.

Note that, when the central processing unit 150 detects that the front end of a paper is downstream of the first conveyor roller 116 and the first driven roller 117 by the third paper detection signal from the third paper detector 118, it controls the drive unit 145 to stop the rotation of the paper feed roller 111 and retard roller 112 so that the next paper is not fed. After that, when the central processing unit 150 detects the rear end of the paper downstream of the paper feed roller 111 and the retard roller 112 by the second paper detection signal from the second paper detector 114, it again controls the drive unit 145 to rotate the paper feed roller 111 and retard roller 112 and convey the next paper. Due to this, the central processing unit 150 prevents a plurality of papers from being superposed in the conveyance path. For this reason, the position jam detector 154 may start counting the time at the point of time when the central processing unit 150 controls the drive unit 145 to rotate the paper feed roller 111 and the retard roller 112 and determine that a position jam has occurred when the third paper detector 118 does not detect the front end of a paper within a predetermined time.

Figure 19:
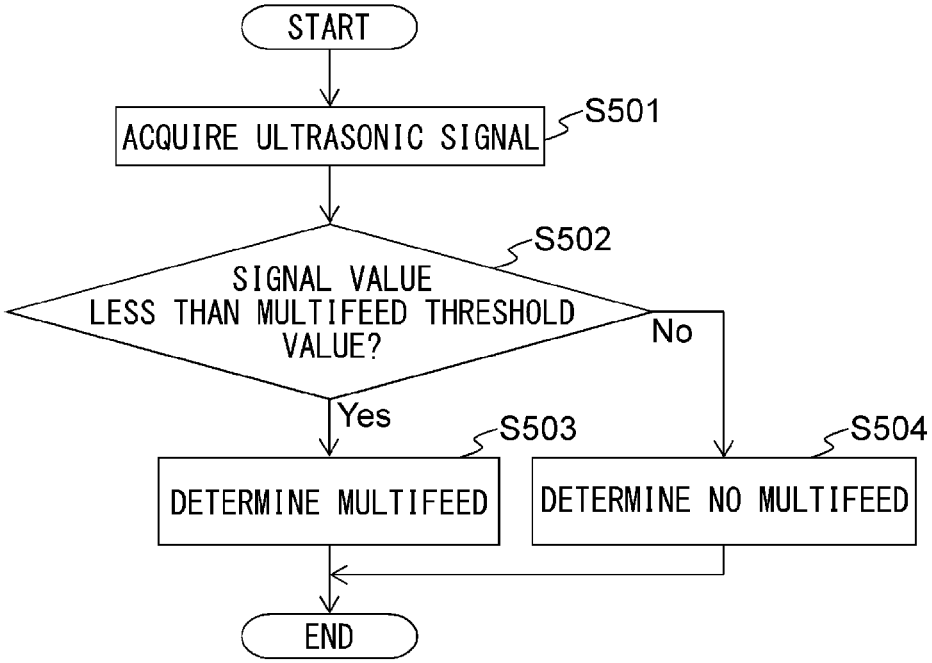
FIG. 19 is a flow chart which shows an example of operation of multifeed detection processing.

FIG. 19 is a flow chart which shows an example of operation of multifeed detection processing.

The flow of operation which is shown in FIG. 19 is executed at step S203 of the flow chart which is shown in FIG. 8.

First, the multifeed detector 155 acquires an ultrasonic signal from the ultrasonic sensor 115 (step S501).

Next, the multifeed detector 155 determines whether the signal value of the acquired ultrasonic signal is less than the multifeed detection threshold value (step S502).

Figure 20:
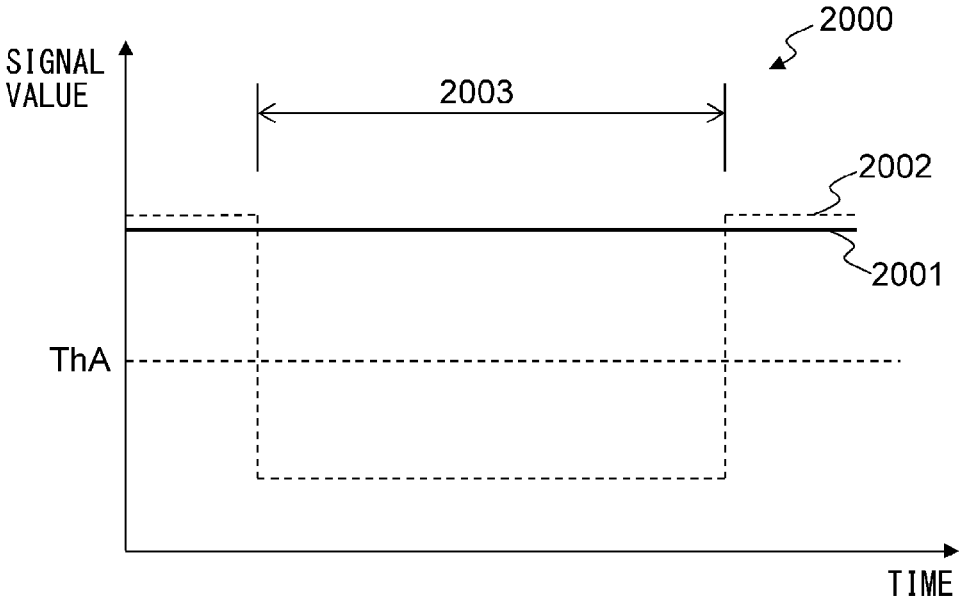
FIG. 20 a view for explaining properties of an ultrasonic signal.

FIG. 20 is a view for explaining properties of an ultrasonic signal.

In the graph 2000 of FIG. 20, the solid line 2001 shows the characteristic of the ultrasonic signal in the case where a single paper is conveyed, while the broken line 2002 shows the characteristic of the ultrasonic signal in the case where multifeed of papers has occurred. The abscissa of the graph 2000 shows the time, while the ordinate shows the signal value of the ultrasonic signal. Due to the occurrence of multifeed, the signal value of the ultrasonic signal of the broken line 2002 falls in the section 2003. For this reason, it is possible to determine whether multifeed of papers has occurred by whether the signal value of the ultrasonic signal is less than the multifeed detection threshold value ThA.

The multifeed detector 155 determines that multifeed of the papers has occurred when the signal value of the ultrasonic signal is less than the multifeed detection threshold value (step S503), determines that multifeed of the papers has not occurred when the signal value of the ultrasonic signal is the multifeed detection threshold value or more (step S504), and ends the series of steps. Note that, when multifeed detection processing is not necessary in the paper conveying apparatus, this may be omitted.

As explained above in detail, the paper conveying apparatus 100 can operate in accordance with the flow charts which are shown in FIG. 6, FIG. 7, and FIG. 9 so as to substantially remove the sound which is generated along with conveyance of a paper, in particular the sound which is generated due to a wrinkle of the paper, based on the sub source signal which is generated from the sound which the first microphone 113*a* which is provided near the paper feed rollers 111 and retard rollers 112 detects. Therefore, the paper conveying apparatus 100 can suppress erroneous detection of the occurrence of a jam by sound due to the sound which is generated along with conveyance of a paper.

Figure 21:
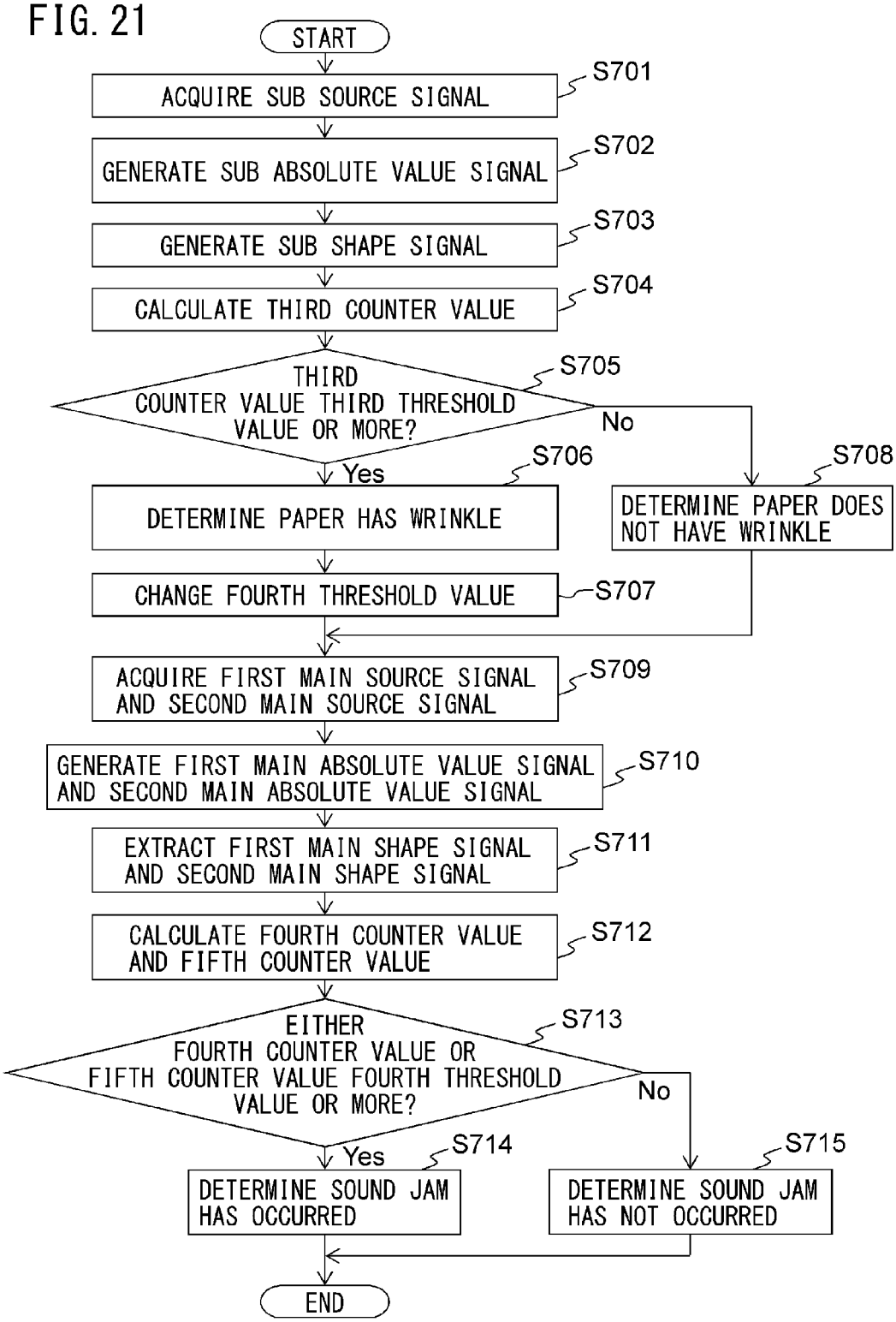
FIG. 21 is a flow chart which shows another example of the operation of sound jam detection processing.

FIG. 21 is a flow chart which shows another example of the operation of the processing for detection of a sound jam.

This flow chart can be followed in the paper conveying apparatus 100 instead of the above-mentioned flow chart which is shown in FIG. 9. In the flow chart which is shown in FIG. 21, unlike the flow chart which is shown in FIG. 9, the sound jam detector 153 determines a sound jam based on the first main source signal and second main source signal instead of determining a sound jam based on the first differential signal and second differential signal. Further, the sound jam detector 153 determines whether a paper has a wrinkle based on the sub source signal and changes the detection method of a jam if it is determined that the paper has a wrinkle.

First, the sound jam detector 153 acquires a sub source signal from the first sound signal generator 141*a* (step S701).

Next, the sound jam detector 153 generates a sub absolute signal of the absolute value for the sub source signal (step S702).

Next, the sound jam detector 153 generates a sub shape signal is a shape extracted from the sub absolute value signal (step S703).

Next, the sound jam detector 153 calculates a third counter value which it makes increase when the sub shape signal is a first threshold value Th1 or more and which it makes decrease when it is less than the first threshold value Th1 (step S704).

Next, the sound jam detector 153 determines whether the third counter value is a third threshold value Th3 or more (step S705). The sound jam detector 153 determines that the conveyed paper has a wrinkle if the third counter value is the third threshold value Th3 or more (step S706) and changes a fourth threshold value Th4 and a fifth threshold value Th5 to predetermined values larger than the ordinary values (step S707). Details of the fourth threshold value Th4 and the fifth threshold value Th5 will be explained later. On the other hand, the sound jam detector 153 determines that the conveyed paper does not have a wrinkle if the third counter value is less than the third threshold value Th3 (step S708).

Next, the sound jam detector 153 acquires the first main source signal from the second sound signal generator 141*b* and acquires the second main source signal from the third sound signal generator 141*c* (step S709).

Next, the sound jam detector 153 generates a first main absolute value signal of the absolute value of the first main source signal and a second main absolute value signal of the absolute value of the second main source signal (step S710).

Next, the sound jam detector 153 generates a first main shape signal which is a shape extracted from the first main absolute value signal and a second main shape signal is a shape extracted from the second main absolute value signal (step S711).

Next, the sound jam detector 153 calculates a fourth counter value which it makes increase when the first main shape signal is the first threshold value Th1 or more and which it makes decrease when it is less than the first threshold value Th1. Similarly, the sound jam detector 153 calculates a fifth counter value which it makes increase when the second main shape signal is the first threshold value Th1 or more and which it makes decrease when it is less than the first threshold value Th1 (step S712).

Next, the sound jam detector 153 determines whether at least one of the fourth counter value and the fifth counter value is the fourth threshold value Th4 or more (step S713). The sound jam detector 153 determines that a sound jam has occurred if at least one of the fourth counter value and the fifth counter value is the fourth threshold value Th4 or more (step S714). On the other hand, the sound jam detector 153 determines that no sound jam has occurred and ends the series of steps if both of the fourth counter value and the fifth counter value are less than the fourth threshold value Th4 (step S715).

Note that, instead of changing the fourth threshold value Th4 and the fifth threshold value Th5 to predetermined values larger than the ordinary values at step S707, the sound jam detector 153 may also change the first threshold value Th1 for determining whether to increment or decrement the fourth counter value and the fifth counter value to predetermined values larger than the ordinary values.

FIG. 22 gives graphs which show examples of signals for detection of a sound jam in a case where a paper which has a wrinkle is conveyed and no jam occurs.

Figure 22A:
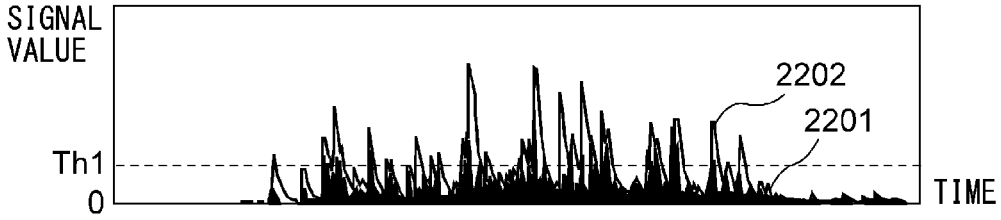
FIG. 22A is a graph which shows an example of a sub shape signal of a paper which has a wrinkle.
Figure 22B:
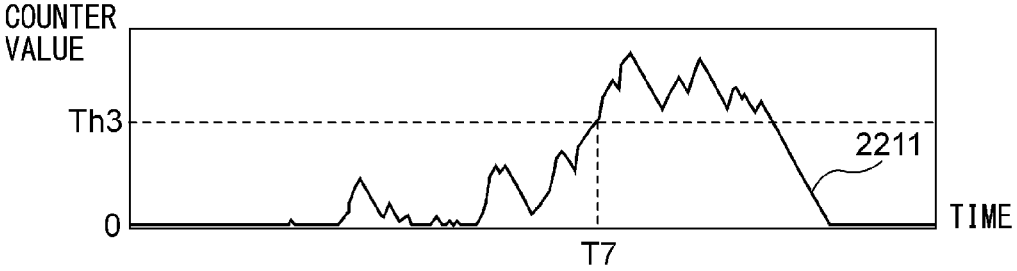
FIG. 22B is a graph which shows an example of a third counter value of a paper which has a wrinkle.
Figure 22C:
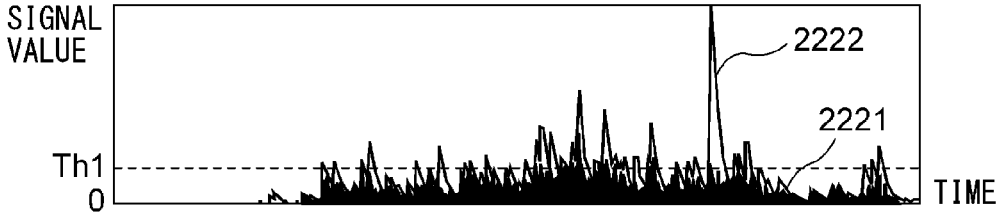
FIG. 22C is a graph which shows an example of a first main shape signal of a paper which has a wrinkle.
Figure 22D:
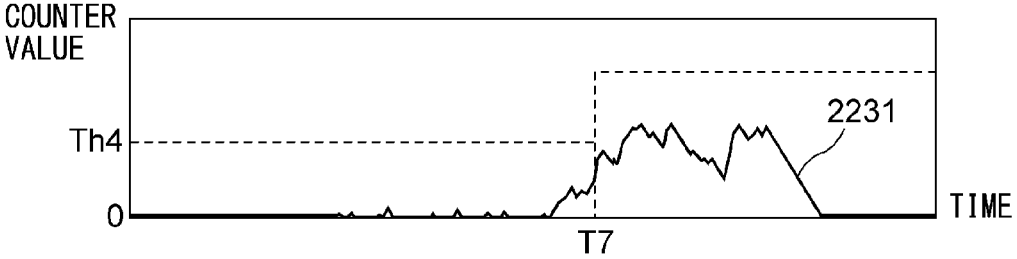
FIG. 22D is a graph which shows an example of a fourth counter value of a paper which has a wrinkle.

The abscissas of FIG. 22A, FIG. 22B, FIG. 22C, and FIG. 22D show the time, the ordinates of FIG. 22A and FIG. 22C show the signal value, and the ordinates of FIG. 22B and FIG. 22D show the counter value. The graph of FIG. 22A shows an example of a sub absolute value signal 2201 in a case where a paper which has a wrinkle is conveyed and no jam occurs and a sub shape signal 2202 which is generated from the sub absolute value signal 2201 (see FIG. 21, step S702, S703). The graph of FIG. 22B shows an example of a third counter value 2211 which is calculated for the sub shape signal 2202 (see FIG. 21, step S704). The graph of FIG. 22C shows an example of a first main absolute value signal 2221 in a case where a paper which has a wrinkle is conveyed and no jam occurs and a first main shape signal 2222 which is generated from the first main absolute value signal 2221 (see FIG. 21, step S710, S711). The graph of FIG. 22D shows an example of a fourth counter value 2231 which is calculated for the first main shape signal 2222 (see FIG. 21, step S712).

As shown in FIG. 22A, due to the sound which is generated at the paper feed rollers 111 and retard rollers 112 due to a paper which has a wrinkle, the signal value of the sub shape signal 2202 frequently becomes the first threshold value Th1 or more. As shown in FIG. 22B, the third counter value becomes the third threshold value Th3 or more at the time T7 whereby it is determined that the paper has a wrinkle. Therefore, in this case, at the time T7, the fourth threshold value Th4 is changed.

On the other hand, as shown in FIG. 22C, due to the sound which is generated at the paper feed rollers 111 and retard rollers 112 due to a paper which has a wrinkle, the signal value of the first main shape signal 2222 also frequently becomes the first threshold value Th1 or more. However, as shown in FIG. 22D, at the time T7, the fourth threshold value Th4 is changed to a large value, so the fourth counter value does not become the fourth threshold value Th4 or more and when a paper which has a wrinkle is conveyed, it is not determined that a sound jam has occurred.

FIG. 23 gives graphs which show examples of signals for detection of a sound jam in the case where a paper which does not have a wrinkle is conveyed and a skew jam occurs.

Figure 23A:
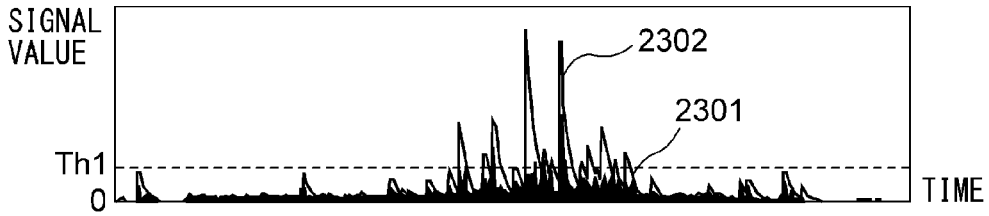
FIG. 23A is a graph which shows an example of a sub shape signal at the time of occurrence of a skew jam.
Figure 23B:
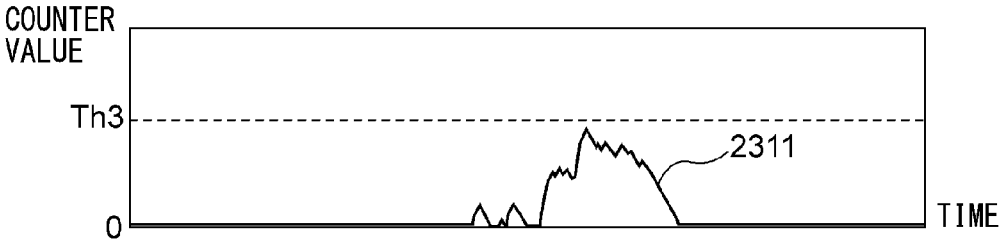
FIG. 23B is a graph which shows an example of a third counter value at the time of occurrence of a skew jam.
Figure 23C:
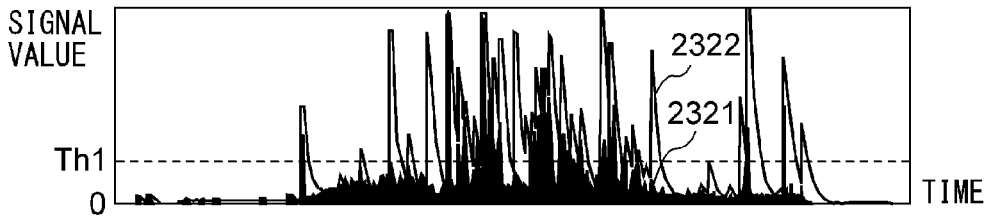
FIG. 23C is a graph which shows an example of a first main shape signal at the time of occurrence of a skew jam.
Figure 23D:
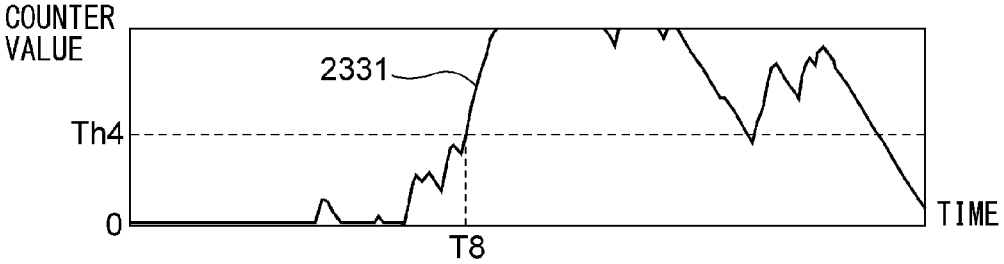
FIG. 23D is a graph which shows an example of a fourth counter value at the time of occurrence of a skew jam.

The abscissas of FIG. 23A, FIG. 23B, FIG. 23C, and FIG. 23D show the time, the ordinates of FIG. 23A and FIG. 23C show the signal value, and the ordinates of FIG. 23B and FIG. 23D show the counter value. The graph of FIG. 23A shows an example of a sub absolute value signal 2301 in the case where a paper which does not have a wrinkle is conveyed and a skew jam occurs and a sub shape signal 2302 which is generated from the sub absolute value signal 2301. The graph of FIG. 23B shows an example of a third counter value 2311 which is calculated for a sub shape signal 2302. The graph of FIG. 23C shows an example of a first main absolute value signal 2321 in the case where a paper which does not have a wrinkle is conveyed and a skew jam occurs and a first main shape signal 2322 which is generated from the first main absolute value signal 2321. The graph of FIG. 23D shows an example of a fourth counter value 2331 which is calculated for the first main shape signal 2322.

As shown in FIG. 23A, the conveyed paper does not have a wrinkle, so the signal value of the sub shape signal 2302 frequently does not become the first threshold value Th1 or more. As shown in FIG. 23B, the third counter value 2311 does not become the third threshold value Th3 or more, so it is determined that the paper does not have a wrinkle. Therefore, in this case, the fourth threshold value Th4 is not changed.

On the other hand, as shown in FIG. 23C, due to the sound caused by a skew jam, the signal value of the first main absolute value signal 2321 frequently becomes the first threshold value Th1 or more. Therefore, as shown in FIG. 23D, the fourth counter value 2331 becomes the fourth threshold value Th4 or more at the time T8 whereby it is determined that a sound jam has occurred.

FIG. 24 gives graphs which show examples of signals for detection of a sound jam in the case where a paper which does not have a wrinkle is conveyed and a staple jam occurs.

Figure 24A:
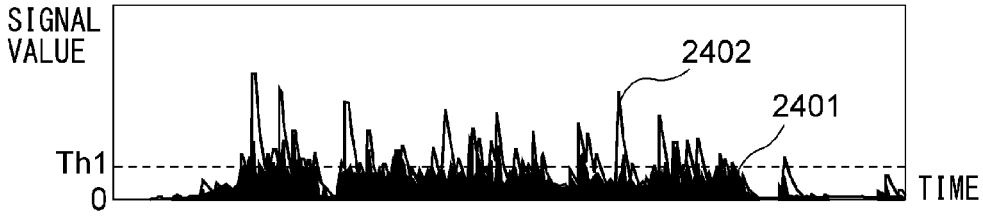
FIG. 24A is a graph which shows an example of a sub shape signal at the time of occurrence of a staple jam.
Figure 24B:
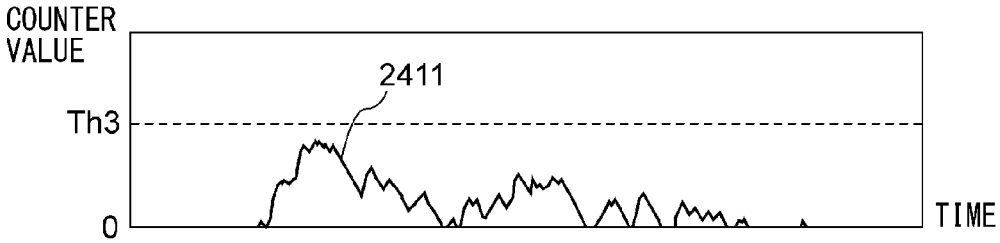
FIG. 24B is a graph which shows an example of a third counter value at the time of occurrence of a staple jam.
Figure 24C:
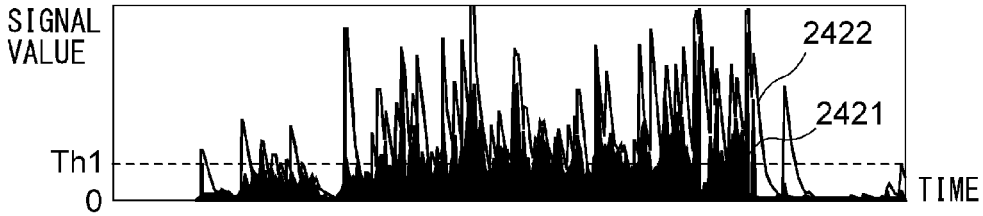
FIG. 24C is a graph which shows an example of a first main shape signal at the time of occurrence of a staple jam.
Figure 24D:
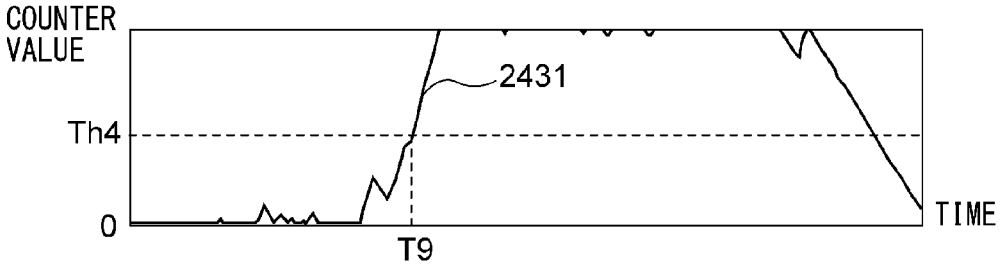
FIG. 24D is a graph which shows an example of a fourth counter value at the time of occurrence of a staple jam.

The abscissas of FIG. 24A, FIG. 24B, FIG. 24C, and FIG. 24D show the time, the ordinates of FIG. 24A and FIG. 24C show the signal value, and the ordinates of FIG. 24B and FIG. 24D show the counter value. The graph of FIG. 24A shows an example of a sub absolute value signal 2401 in the case where a paper which does not have a wrinkle is conveyed and a staple jam occurs and a sub shape signal 2402 which is generated from the sub absolute value signal 2401. The graph of FIG. 24B shows an example of a third counter value 2411 which is calculated for the sub shape signal 2402. The graph of FIG. 24C shows an example of a first main absolute value signal 2421 in the case where a paper which does not have a wrinkle is conveyed and a staple jam occurs and a first main shape signal 2422 which is generated from the first main absolute value signal 2421. The graph of FIG. 24D shows an example of a fourth counter value 2431 which is calculated for the first main shape signal 2422.

As shown in FIG. 24A, the conveyed paper does not have a wrinkle, so the signal value of the sub shape signal 2402 frequently does not become the first threshold value Th1 or more. As shown in FIG. 24B, the third counter value 2411 does not become the third threshold value Th3 or more, so it is determined that the paper does not have a wrinkle. Therefore, in this case, the fourth threshold value Th4 is not changed.

On the other hand, as shown in FIG. 24C, due to the sound which is generated by a staple, the signal value of the first main shape signal 2422 frequently becomes the first threshold value Th1 or more. Therefore, as shown in FIG. 24D, the fourth counter value 2431 becomes the fourth threshold value Th4 or more at the time T9 whereby it is determined that a sound jam has occurred.

FIG. 25 gives graphs which show examples of signals for detection of a sound jam in the case where a paper which has a wrinkle is conveyed and a skew jam occurs.

Figure 25A:
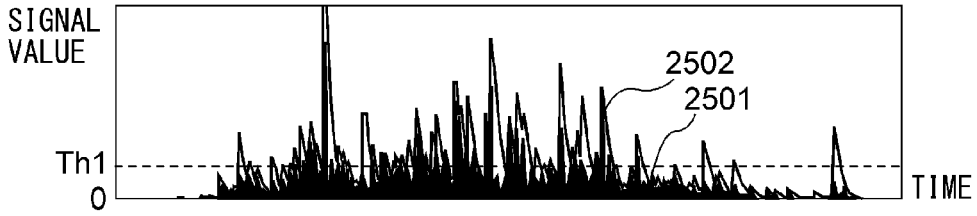
FIG. 25A is a graph which shows an example of a sub shape signal at the time of occurrence of a staple jam.
Figure 25B:
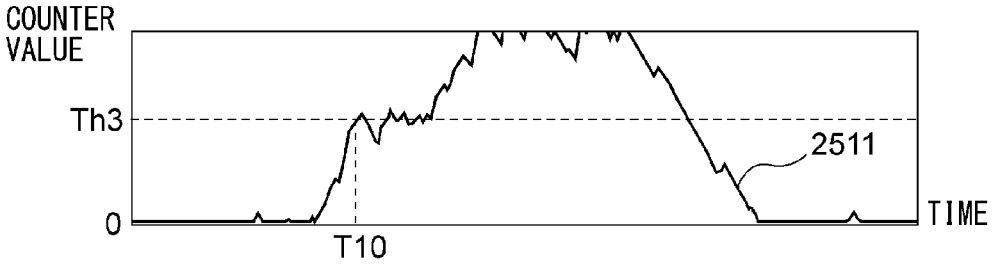
FIG. 25B is a graph which shows an example of a third counter value at the time of occurrence of a skew jam.
Figure 25C:
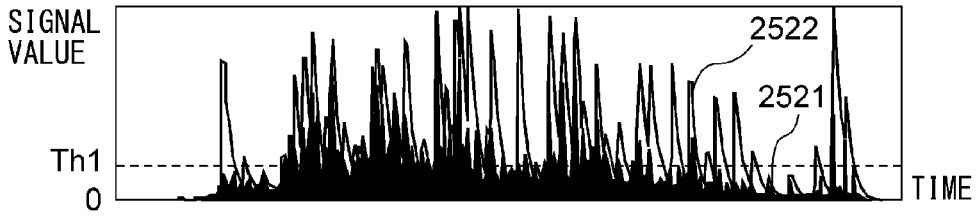
FIG. 25C is a graph which shows an example of a first main shape signal at the time of occurrence of a skew jam.
Figure 25D:
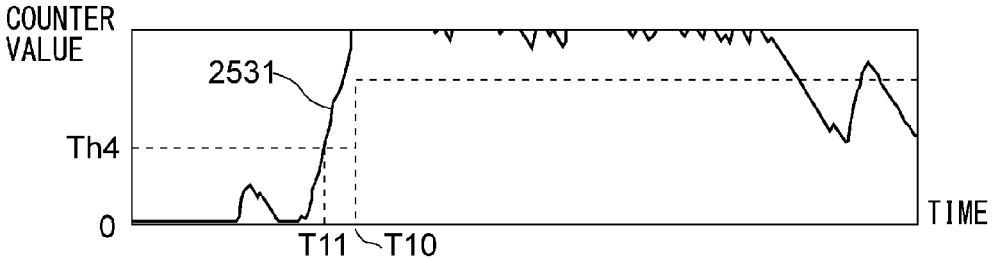
FIG. 25D is a graph which shows an example of a fourth counter value at the time of occurrence of a skew jam.

The abscissas of FIG. 25A, FIG. 25B, FIG. 25C, and FIG. 25D show the time, the ordinates of FIG. 25A and FIG. 25C show the signal value, and the ordinates of FIG. 25B and FIG. 25D show the counter value. The graph of FIG. 25A shows an example of a sub absolute value signal 2501 in a case where a paper which has a wrinkle is conveyed and a skew jam occurs and a sub shape signal 2502 which is generated from the sub absolute value signal 2501. The graph of FIG. 25B shows an example of a third counter value 2511 which is calculated for the sub shape signal 2502. The graph of FIG. 25C shows an example of a first main absolute value signal 2521 in a case where a paper which has a wrinkle is conveyed and a skew jam occurs and a first main shape signal 2522 which is generated from the first main absolute value signal 2521. The graph of FIG. 25D shows an example of a fourth counter value 2531 which is calculated for the first main shape signal 2522.

As shown in FIG. 25A, due to the sound which is generated at the paper feed rollers 111 and retard rollers 112 due to a paper which has a wrinkle, the signal value of the sub shape signal 2502 frequently becomes the first threshold value Th1 or more. As shown in FIG. 25B, the third counter value 2511 becomes the third threshold value Th3 or more at the time T10, whereby it is determined that the paper has a wrinkle. Therefore, in this case, the fourth threshold value Th4 is changed at the time T10.

On the other hand, as shown in FIG. 25C, due to the sound caused by a skew jam, the signal value of the first main shape signal 2522 frequently becomes the first threshold value Th1 or more. Therefore, as shown in FIG. 25D, the fourth counter value 2531 becomes the fourth threshold value Th4 or more at the time T11 before the time T10 at which the fourth threshold value Th4 is changed, whereby it is determined that a sound jam has occurred. Note that, the fourth counter value 2531 takes a value larger than the fourth threshold value Th4 after the change, so even if the time T10 at which the fourth threshold value Th4 is changed is before the time T11, it is determined that a sound jam has occurred.

FIG. 26 gives graphs which show examples of signals for detection of a sound jam in the case where a paper which has a wrinkle is conveyed and a staple jam occurs.

Figure 26A:
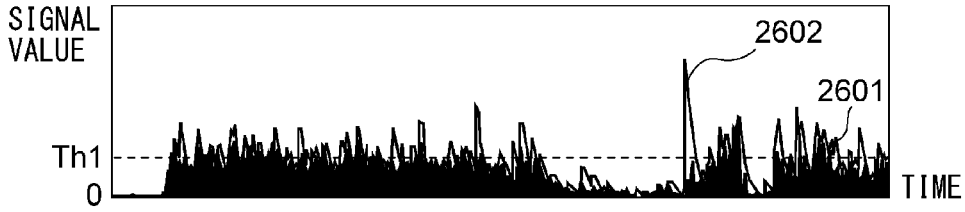
FIG. 26A is a graph which shows an example of a sub shape signal at the time of occurrence of a staple jam.
Figure 26B:
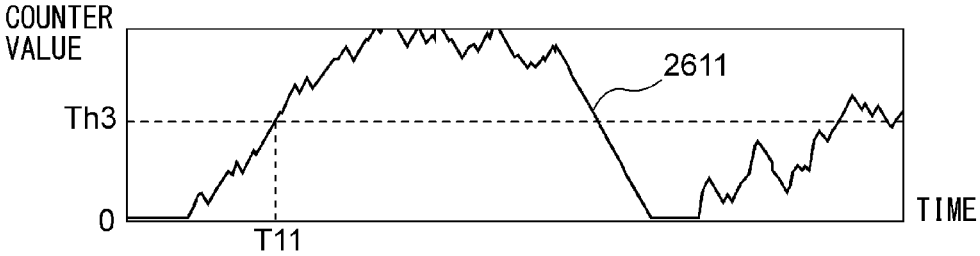
FIG. 26B is a graph which shows an example of a third counter value at the time of occurrence of a staple jam.
Figure 26C:
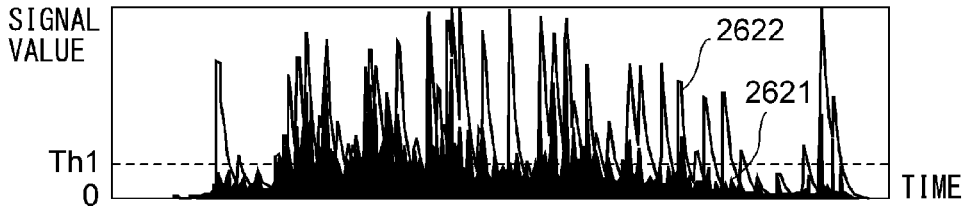
FIG. 26C is a graph which shows an example of a first main shape signal at the time of occurrence of a staple jam.
Figure 26D:
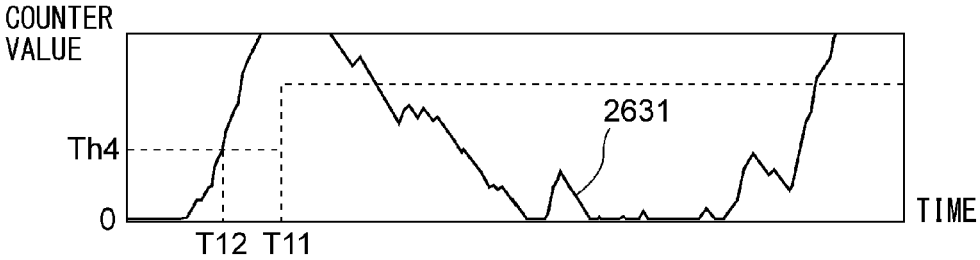
FIG. 26D is a graph which shows an example of a fourth counter value at the time of occurrence of a staple jam.

The abscissas of FIG. 26A, FIG. 26B, FIG. 26C, and FIG. 26D show the time, the ordinates of FIG. 26A and FIG. 26C show the signal value, and the ordinates of FIG. 26B and FIG. 26D show the counter value. The graph of FIG. 26A shows an example of a sub absolute value signal 2601 in the case where a paper which has a wrinkle is conveyed and a staple jam occurs and a sub shape signal 2602 which is generated from the sub absolute value signal 2601. The graph of FIG. 26B shows an example of a third counter value 2611 which is calculated for the sub shape signal 2602. The graph of FIG. 26C shows an example of a first main absolute value signal 2621 in the case where a paper which has a wrinkle is conveyed and a staple jam occurs and a first main shape signal 2622 which is generated from the first main absolute value signal 2621. The graph of FIG. 26D shows an example of a fourth counter value 2631 which is calculated for the first main shape signal 2622.

As shown in FIG. 26A, due to the sound which is generated at the paper feed rollers 111 and retard rollers 112 due to a paper which has a wrinkle, the signal value of the sub shape signal 2602 which is generated from the sub sound signal frequently becomes the first threshold value Th1 or more. As shown in FIG. 26B, the third counter value 2611 becomes the third threshold value Th3 or more at the time T12 whereby it is determined that the paper has a wrinkle. Therefore, in this case, the fourth threshold value Th4 is changed at the time T12.

On the other hand, as shown in FIG. 26C, due to the sound caused by a skew jam, the signal value of the first main shape signal 2622 frequently becomes the first threshold value Th1 or more. Therefore, as shown in FIG. 26D, the fourth counter value 2631 becomes the fourth threshold value Th4 or more at the time T13, before the time T12 where the fourth threshold value Th4 is changed, whereby it is determined that a sound jam has occurred. Note that, the fourth counter value 2631 takes a larger value than the fourth threshold value Th4 after change, so even if the time T12 where the fourth threshold value Th4 is changed is before the time T13, it is determined that a sound jam has occurred.

In the above way, the sound jam detector 153 does not determine that a sound jam has occurred even when a paper which has a wrinkle is conveyed if no skew jam or staple jam occurs. On the other hand, the sound jam detector 153 can determine that a sound jam has occurred if a skew jam or staple jam has occurred regardless if the paper has a wrinkle.

As explained above in detail, the paper conveying apparatus 100 operates in accordance with the flow charts which are shown in FIG. 6, FIG. 7, and FIG. 21 so as to determine whether a paper has a wrinkle based on the sub source signal and can change the threshold value which is used for detection of a jam by sound when determining that the paper has a wrinkle. For this reason, the paper conveying apparatus 100 can suppress erroneous detection of the occurrence of a jam by sound due to a sound which occurs along with conveyance of a paper.

Figure 27:
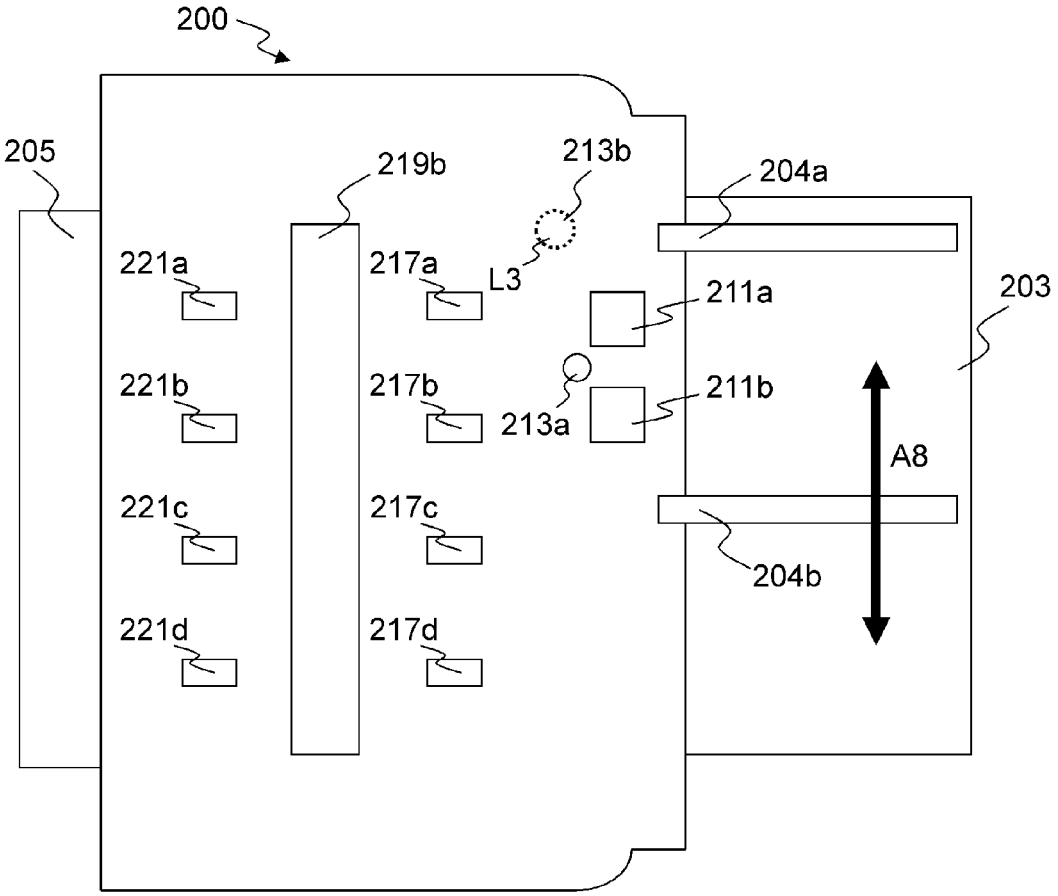
FIG. 27 is another example of a view of a paper conveying apparatus 200 seen from above after detaching an upper housing 102, according to another embodiment.

FIG. 27 is another example of view of a paper conveying apparatus 200 seen from above in the state where the upper housing 102 is detached, that is, a view seen in the opposite direction to the arrow mark A7 of FIG. 2, according to another embodiment.

The paper conveying apparatus 200 which is shown in FIG. 27 is a paper conveying apparatus of a type which feeds paper by a single-side reference by having one of the two side guides fixed in place.

The paper conveying apparatus 200 has a paper tray 203, side guides 204*a*, 204*b*, paper feed rollers 211*a*, 211*b*, first microphone 213*a*, second microphone 213*b*, first driven rollers 217*a*, 217*b*, 217*c*, 217*d*, image capture unit 219*b*, second driven rollers 221*a*, 221*b*, 221*c*, 221*d*, ejection tray 205, etc.

In the paper conveying apparatus 200, the side guide 204*a* is fixed in place and only the side guide 204*b* can move in the left-right direction with respect to the conveyance direction of the paper. The side guide 204*b* can be positioned to be matched to the width of the paper so as to restrict the width direction of the paper.

The first microphone 213*a* is provided near the paper feed rollers 211*a* and 211*b*. The second microphone 213*b* is provided at the conveyance path of the paper at one end at the fastened side guide 204*a* side.

In a paper conveying apparatus 200 of a type which feeds paper by a single sided reference, the side guide 204*a* and the side wall of the conveyance path of the paper at the side guide 204*a* side are arranged at close positions, so if a paper is conveyed skewed toward the side guide 204*a* side, a skew jam will easily occur. However, the side guide 204*b* and the side wall of the conveyance path of the paper at the side guide 204*b* side are arranged separated from each other, so even if a paper is conveyed skewed toward the side guide 204*b* side, a skew jam will hardly ever occur. For this reason, in the paper conveying apparatus 200, even if not providing a microphone at the conveyance path of the paper at the end at the side guide 204*b* side, it is possible to precisely detect a skew jam.

As explained above in detail, in the paper conveying apparatus 200, the second microphone 213*b* is provided at the conveyance path of the paper at one end at the fastened side guide 204*a* side, so it becomes possible to precisely detect a skew jam in a paper conveying apparatus of a type which feeds paper by a single sided reference.

According to the paper conveying apparatus and the jam detection method, and the computer-readable, non-transitory medium, it is possible to reduce the sound which is generated along with conveyance of a paper based on a sound signal which is generated by a sound signal generator which is provided near a separator of the paper, so it becomes possible to suppress erroneous detection of the occurrence of a jam by a sound due to the sound which is generated along with conveyance of the paper.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

What is claimed is:

1. A paper conveying apparatus comprising:

a separator;

a first sound signal generator for generating a first sound signal corresponding to a sound generated by a paper during conveyance of the paper, wherein said first sound detector is provided near the separator;

a second sound signal generator for generating a second sound signal corresponding to the sound generated by the paper during conveyance of the paper, wherein said second sound detector is provided at least at one end of a conveyance path of the paper in a direction which perpendicularly intersects a paper conveyance direction; and a sound jam detector for determining whether a jam has occurred based on the second sound signal according to a detection method, wherein the sound jam detector determines whether the jam has occurred based on a difference acquired by subtracting the first sound signal from the second sound signal.

2. The paper conveying apparatus according to claim 1, wherein the second sound detector is provided at both ends of the conveyance path of the paper in the direction which perpendicularly intersects the paper conveyance direction.

3. The paper conveying apparatus according to claim 1, wherein the first sound signal and the second sound signal are signals the shapes of which are extracted from signals generated from the sound generated by the paper during conveyance of the paper.

4. The paper conveying apparatus according to claim 1, wherein the first sound signal and the second sound signal are signals digitized from signals generated from the sound generated by the paper during conveyance of the paper.

5. The paper conveying apparatus according to claim 1, wherein the sound jam detector determines whether the jam has occurred by comparing information based on the second sound signal and a predetermined threshold value.

6. A jam detection method comprising:

acquiring a first sound signal from a first sound signal generator for generating a first sound signal corresponding to a sound generated by a paper during conveyance of the paper, wherein said first sound detector is provided near a separator;

acquiring a second sound signal from a second sound signal generator for generating a second sound signal corresponding to the sound generated by the paper during conveyance of the paper, wherein said second sound detector is provided at least at one end of a conveyance path of the paper in a direction which perpendicularly intersects a paper conveyance direction;

determining, by a computer, whether a jam has occurred based on the second sound signal according to a detection method; and determining by the computer whether the jam has occurred based on a difference acquired by subtracting the first sound signal from the second sound signal.

7. A computer-readable, non-transitory medium storing a computer program, wherein the computer program causes a computer to execute a process, the process comprising:

acquiring a first sound signal from a first sound signal generator for generating a first sound signal corresponding to a sound generated by a paper during conveyance of the paper, wherein said first sound detector is provided near a separator;

acquiring a second sound signal from a second sound signal generator for generating a second sound signal corresponding to the sound generated by the paper during conveyance of the paper, wherein said second sound detector is provided at least at one end of a conveyance path of the paper in a direction which perpendicularly intersects a paper conveyance direction;

determining whether a jam has occurred based on the second sound signal according to a detection method; and determining by the computer whether the jam has occurred based on a difference acquired by subtracting the first sound signal from the second sound signal.

* * * * *